US007186208B2

(12) United States Patent
Demers et al.

(10) Patent No.: US 7,186,208 B2
(45) Date of Patent: Mar. 6, 2007

(54) CUTTERLESS DUNNAGE CONVERTER AND METHOD

(75) Inventors: Raimond Demers, Landgraaf (NL); Erwin Riga, Sittard (NL); Dan Coppus, Doenrade (NL); Patrick Klemke, Plombieres (BE); Kristien Varrewaere, Eupen (BE)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 10/887,220

(22) Filed: Jul. 7, 2004

(65) Prior Publication Data

US 2005/0181924 A1 Aug. 18, 2005

(51) Int. Cl.
*B31F 5/02* (2006.01)

(52) U.S. Cl. ..... 493/350; 493/352; 493/354; 493/967

(58) Field of Classification Search ..... 225/96.5, 225/98, 99, 105, 106, 100, 101; 493/350, 493/352, 354, 361, 904, 967
See application file for complete search history.

(56) References Cited

U.S. PATENT DOCUMENTS

| | | | | |
|---|---|---|---|---|
| 3,155,314 | A | 11/1964 | Kreider | |
| 3,162,922 | A | 12/1964 | Alziari | |
| 3,603,216 | A | 9/1971 | Johnson | |
| 3,641,841 | A | 2/1972 | Komori | |
| 3,843,017 | A * | 10/1974 | Harrison | 221/63 |
| 4,026,198 | A | 5/1977 | Ottaviano | |
| 4,650,456 | A | 3/1987 | Armington | |
| 4,688,708 | A * | 8/1987 | Irvine et al. | 225/100 |
| 4,739,641 | A | 4/1988 | Hering | |
| 4,747,816 | A * | 5/1988 | Matsuyama et al. | 493/407 |
| 4,750,896 | A * | 6/1988 | Komaransky et al. | 493/357 |
| 4,789,322 | A | 12/1988 | Chan et al. | |
| 4,824,354 | A | 4/1989 | Keaton | |
| 4,858,844 | A * | 8/1989 | Stenqvist | 242/521 |

(Continued)

FOREIGN PATENT DOCUMENTS

| | | |
|---|---|---|
| DE | 4424381 | 1/1996 |

(Continued)

OTHER PUBLICATIONS

International Search Report for PCT/US97/11515.

*Primary Examiner*—Sameh H. Tawfik
(74) *Attorney, Agent, or Firm*—Renner, Otto, Boisselle & Sklar, LLP

(57) ABSTRACT

A tabletop converter has a conversion assembly that inwardly gathers and crumples a stock material to form a strip of dunnage. The conversion assembly includes a feeding assembly that moves the stock material and a controller that controls the feeding assembly to operate in both a forward direction and a reverse direction. To automatically separate a discrete dunnage product from the strip, a holder grabs and holds the strip of dunnage at a holding location downstream of the feeding assembly. The feeding assembly then operates in a reverse direction and urges the strip away from the holding location. This causes the strip to separate at or between the holding location and the feeding assembly, leaving a discrete dunnage product ready for use. The converter is mounted to a stand that allows the converter to rotate relative to part of the stand about both a horizontal axis and a vertical axis.

24 Claims, 17 Drawing Sheets

U.S. PATENT DOCUMENTS

| | | | | | |
|---|---|---|---|---|---|
| 4,938,739 | A | | 7/1990 | Nilsson | |
| 4,982,337 | A | * | 1/1991 | Burr et al. | 700/235 |
| 5,044,270 | A | | 9/1991 | Schwelling | |
| 5,088,972 | A | | 2/1992 | Parker | |
| 5,123,889 | A | | 6/1992 | Armington et al. | |
| 5,131,903 | A | | 7/1992 | Levine | |
| 5,160,076 | A | * | 11/1992 | Ford | 225/4 |
| 5,173,352 | A | | 12/1992 | Parker | |
| 5,197,318 | A | | 3/1993 | Joyce et al. | |
| 5,203,761 | A | | 4/1993 | Reichental | |
| 5,241,841 | A | | 9/1993 | Schmid | |
| 5,241,885 | A | | 9/1993 | Kuchler | |
| 5,255,627 | A | | 10/1993 | Williams | |
| 5,322,477 | A | | 6/1994 | Armington et al. | |
| 5,340,632 | A | | 8/1994 | Chapius | |
| 5,393,211 | A | | 2/1995 | Hegler | |
| 5,403,259 | A | | 4/1995 | Parker | |
| 5,468,208 | A | | 11/1995 | Armington | |
| 5,487,717 | A | | 1/1996 | Tekavec | |
| 5,573,491 | A | | 11/1996 | Parker | |
| 5,709,642 | A | | 1/1998 | Ratzel et al. | |
| 5,749,824 | A | * | 5/1998 | Guth | 493/464 |
| 5,803,893 | A | | 9/1998 | Armington | |
| 5,806,759 | A | | 9/1998 | Axisa | |
| 5,882,767 | A | | 3/1999 | Simmons, Jr. | |
| 5,938,580 | A | * | 8/1999 | Siekmann | 493/38 |
| 5,989,176 | A | * | 11/1999 | Ratzel et al. | 493/464 |
| 5,997,461 | A | | 12/1999 | Armington | |
| 6,033,353 | A | | 3/2000 | Lencoski et al. | |
| 6,080,097 | A | | 6/2000 | Ratzel et al. | |
| 6,176,818 | B1 | * | 1/2001 | Simmons et al. | 493/346 |
| 6,179,765 | B1 | | 1/2001 | Toth | |
| 6,183,586 | B1 | | 2/2001 | Heidelberger | |
| 6,221,000 | B1 | | 4/2001 | Weder | |
| 6,402,674 | B1 | | 6/2002 | Simmons et al. | |
| 6,416,451 | B1 | | 7/2002 | Ratzel | |
| 6,669,071 | B1 | * | 12/2003 | Menna | 225/106 |
| 6,732,896 | B2 | * | 5/2004 | Brazell | 225/101 |

FOREIGN PATENT DOCUMENTS

| | | |
|---|---|---|
| DE | 19512716 | 1/1996 |
| EP | 0523382 | 6/1992 |
| EP | 0650827 | 5/1995 |
| EP | 08888878 | 1/1999 |
| WO | WO 9106694 | 5/1991 |
| WO | WO 9513914 | 5/1995 |
| WO | WO 9528276 | 10/1995 |
| WO | WO 9603273 | 2/1996 |
| WO | WO 9635576 | 11/1996 |
| WO | WO 9702183 | 1/1997 |
| WO | WO 0194107 | 12/2001 |
| WO | WO 0196097 | 12/2001 |
| WO | WO 03089163 | 10/2003 |

* cited by examiner

CUTTERLESS DUNNAGE CONVERTER AND METHOD

FIELD OF THE INVENTION

The present invention relates generally to a converter and method for converting a stock material into a dunnage product, and to an adjustable stand for supporting a converter.

BACKGROUND

Dunnage conversion machines, also referred to as converters, generally convert a sheet stock material into a strip of dunnage. Some converters produce a dunnage product primarily intended to fill voids in a packaging container to prevent the contents from shifting during shipment. These machines typically operate at relatively high speeds. An exemplary dunnage converter is disclosed in International Patent Application No. PCT/US01/18678, published under Publication No. WO 0194107 on Dec. 13, 2001, and International Patent Application No. PCT/US03/12301, filed on Apr. 22, 2003.

Dunnage converters typically have a severing assembly that uses at least one moving cutting blade to sever discrete dunnage products from the strip. As an alternative, weakened stock material, usually perforated stock material, has been used. Whether the stock material is perforated, or the strip of dunnage is perforated after formation, the perforations form weakened tear lines that allow a packer to tear or otherwise separate dunnage products from the strip by hand, as is disclosed in U.S. Pat. No. 6,033,353.

The '353 patent also discloses a mechanism for automatically tearing dunnage products from the strip. After the converter produces the strip, the mechanism for feeding the stock material through the converter stops. A pair of holding assemblies then pinch and hold the strip at locations spaced along the length of the strip. One of the holding assemblies then moves relative to the other holding assembly to effect tearing of the strip along a perforated tear line, thereby automatically separating a discrete dunnage product from the strip.

Another feature of many dunnage converters in use today is that they are bulky and consume a large amount of valuable floor space. To minimize the floor space occupied by the dunnage converter or to deliver dunnage products at or from an elevated position, converters have been mounted on stands at elevated positions. Some of these converters are mounted for rotation about a vertical axis, for example, as disclosed in U.S. Pat. No. 5,730,696. Other converters are mounted on stands that are adjustable in height and allow the converter to pivot about a horizontal axis to vary the direction in which the converter discharges the dunnage products, as disclosed in U.S. Pat. No. 6,077,209.

SUMMARY

The present invention provides a dunnage conversion machine (i.e., converter) that can automatically separate discrete dunnage products from a dunnage strip without the need for a cutting assembly. The present invention also provides a unique stand for a dunnage converter, a novel packaging system using a single dunnage converter to service multiple packaging stations in an easy and quick manner, as well as other features.

According to one aspect of the invention, a dunnage converter that converts sheet stock material into discrete dunnage products comprises a conversion assembly for converting sheet stock material into a crumpled strip of dunnage. The conversion assembly includes a feeding assembly for engaging the strip at a feeding location for moving the stock material through the converter. The converter also includes a restraining device that allows the stock material to pass in a forward direction and restricts significant movement of the stock material in a reverse direction at a holding location spaced downstream of the feeding assembly, and a controller that controls the feeding assembly to move the stock material therethrough in a forward direction for conversion into the strip of dunnage and in a reverse direction to separate a dunnage product from the strip at a location at or between the holding location and the feeding assembly.

In an exemplary embodiment, the controller directs the feeding assembly to operate in a reverse direction by a preset amount to effect separation of the dunnage product from the strip.

The dunnage converter also can include an upstream restraining device that allows the stock material to pass in a forward direction and inhibits significant reverse movement of the stock material at a location upstream of the feeding location such that the feeding assembly will engage the stock material upon feeding in the forward direction once again. In an exemplary embodiment the upstream restraining device includes a stop member movable between a first position permitting passage of the dunnage strip in a forward direction and a second position inhibits significant reverse movement of the stock material at a location upstream of the feeding location such that the feeding assembly will engage the stock material upon feeding in the forward direction once again. The stop member is moved to its first position by the stock material passing thereby during forward feeding of the stock material by the feeding assembly, and the stop member is moved to its second position by a binding engagement with the stock material when the stock material is moved in a reverse direction by the feeding assembly. The dunnage converter also can have an entry guide chute that constrains the stock material as it passes to the feeding assembly, and the stop member can extend into the entry guide chute for engaging the stock material.

In an exemplary embodiment, the stop member coacts with an opposed surface of the entry guide chute to pinch therebetween the stock material when the stock material is moved in a reverse direction by the feeding assembly. The entry guide chute can be tubular and have a slot through which the stop member extends into the interior of the entry guide chute. The entry guide chute also can form part of a forming assembly located upstream of the feeding assembly for gathering and crumpling the stock material to form the strip of dunnage. The forming assembly can include a gathering chute with converging surfaces that inwardly gathers and crumples the stock material.

The aforesaid downstream restraining device can include at least one restraining member that moves into the path of the stock material to engage the stock material at the holding location downstream of the feeding assembly and hold it against any significant reverse movement at the holding location. The restraining member preferably has an edge that bites into the strip at the holding location. In an exemplary embodiment, an actuator moves the restraining member between a first position permitting passage of the dunnage strip in a forward direction and a second position restricting significant movement of the stock material in a reverse direction at the holding location spaced downstream of the feeding assembly. More preferably, the downstream restraining device includes opposed restraining members that move into the path of the stock material to engage therebetween the stock material at the holding location downstream of the feeding assembly and hold it against any significant reverse movement at the holding location. An actuator mechanism can then move the restraining members away from one another to permit passage of the dunnage strip in a forward direction and toward one another to restrict any significant movement of the stock material in a reverse direction at the holding location spaced downstream of the feeding assembly. Alternatively, the restraining members can be resiliently biased to the closed position. An exit guide chute can be provided to guide the stock material as it passes from the feeding assembly, and the restraining member can be located at an outlet end of the exit guide chute, and the exit guide can be outwardly flared as has been found to reduce the incidence of jams that interrupt the flow of the dunnage product out of the converter.

As is preferred, the dunnage converter uses a stock material having longitudinally spaced-apart weakened areas that extend across the width of the stock material.

According to another aspect of the invention, a dunnage converter is provided in combination with a stand that has an upper part to which the converter is adjustably mounted for rotation about a substantially horizontal axis, and a base to which the upper part is adjustably mounted for rotation about a substantially vertical axis. In one embodiment, the upper part includes a stock supply shelf that supports a supply of stock material for rotation with the converter. In another embodiment, the supply of stock material is supported on the base. In a further embodiment, the supply of stock material is supported separately from the stand.

In a preferred embodiment, the upper part and base respectively include telescoping tubes that are extendable and retractable along the substantially vertical axis of rotation. The base can be configured to be supported on a table. In one embodiment, the base includes a free standing U-shape foot that allows the stand to be supported on a table top. In another embodiment, the base includes a clamp mountable at an edge of a table, and the clamp can support a stock supply magazine that holds one or more units of stock material. In a further embodiment, the base includes a mounting plate for attaching to a table top. Regardless of the base configuration, a stock supply shelf can be mounted to the housing for rotation with the housing.

According to another aspect of the invention, a dunnage converter and method for converting sheet stock material into discrete dunnage products is characterized by forming the sheet stock material into a crumpled strip and feeding the strip in a forward direction through a feeding assembly; engaging and holding the strip at a holding location downstream of the feeding assembly; and pulling the strip in a direction away from the holding location to separate a discrete dunnage product from the strip of dunnage.

According to a further aspect of the invention, a packaging system comprises a dunnage converter rotatably mounted on a fixed stand, a stock supply support mounted for rotation with the dunnage converter, and a plurality of packaging stations circumferentially spaced about the stand, such that the dunnage converter can be rotated between the packaging stations for dispensing dunnage at the packaging stations.

According to a still further aspect of the invention, a dunnage converter that converts sheet stock material into a dunnage product comprises a forming assembly that inwardly gathers and crumples the sheet stock material, and a feeding assembly that moves the sheet stock material through the forming assembly. The feeding assembly includes at least one member that rotates about an axis and a motor that drives the rotating member, the axis of the motor extending in a direction that is substantially parallel to the axis of the rotating member.

According to still another aspect of the invention, a dunnage converter that converts sheet stock material into discrete dunnage products comprises a conversion assembly for converting sheet stock material into a crumpled strip of dunnage that includes a feeding assembly for moving the stock material through the converter, and a constant-entry guide for guiding the stock material from a supply thereof to the conversion assembly. The constant-entry guide is movable between an operating position in the path of the stock material during operation and a loading position clear of the path of the stock material to facilitate loading a new supply of stock material into the converter.

The present invention also provides a dunnage converter that includes a feeding assembly including at least two grippers, at least one of which is movable for feeding the stock material through a gap formed between the opposed grippers, and at least one guide member extending through the gap to guide the stock material as it is fed by the feeding assembly. Preferably, the feeding assembly includes opposed sets of grippers each including laterally spaced-apart portions that define therebetween an aperture operative to gather and laterally capture therein the dunnage strip and which laterally spaced-apart portions of opposed grippers together define therebetween the aforesaid gap.

The foregoing and other features of the invention are fully described and particularly pointed out in the claims, the following description and annexed drawings setting forth in detail one or more illustrative embodiments of the invention, these embodiments being indicative, however, of but a few of the various ways in which the principles of the invention may be employed.

DETAILED DESCRIPTION

Figure 1:
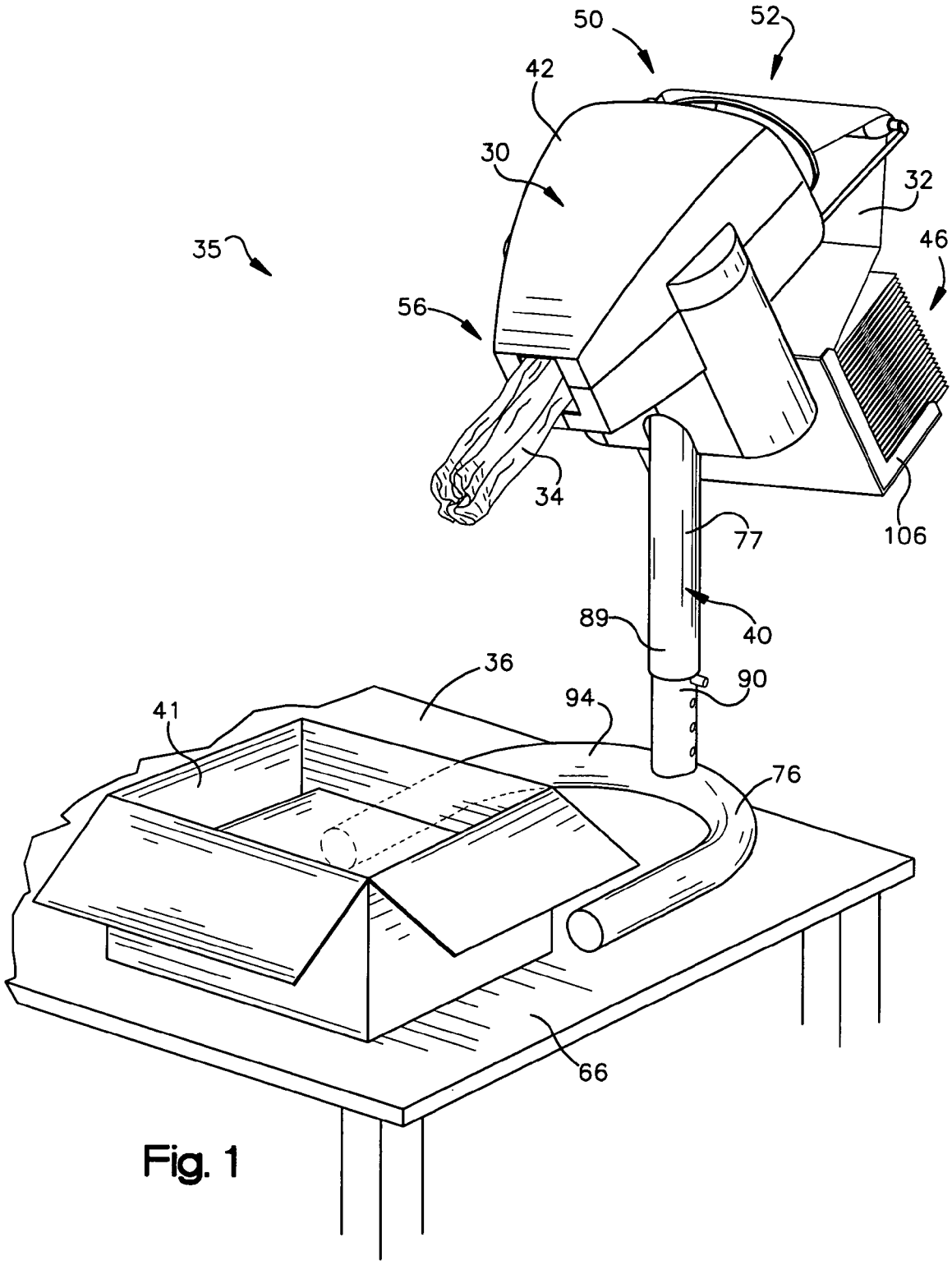
FIG. 1 is a perspective view of an exemplary packaging system in accordance with the present invention that includes a table with a packing surface, a container resting on the packing surface, and a dunnage converter mounted on a tabletop stand for elevated above the packing surface to supply dunnage products.

Referring now in detail to the drawings, FIG. 1 shows a dunnage conversion machine (i.e., converter) 30 in accordance with the invention that converts a sheet stock material 32 into a strip 34 of dunnage that is both voluminous and stable. A preferred dunnage strip primarily intended for void-fill applications generally has a round cross-sectional shape.

The converter 30 is shown as part of a packaging system 35 that also includes a table 36 and an adjustable stand 40 on which the converter 30 is mounted. The stand 40 supports the converter 30 on the table 36 to discharge dunnage products where they are needed, including directly into a container 41.

The converter 30 includes a housing 42 that encloses a conversion assembly described in detail below, the conversion assembly functioning to convert stock material, particularly sheet stock material, into a dunnage product, which also is described in detail below. In the embodiment illustrated in FIG. 1, the sheet stock material is fed into the housing 42 from a supply thereof supported on a stock supply assembly 46 provided at an upstream end 50 of the converter 30. The converted stock material exits the housing 42 at a downstream end 56 of the converter 30 as the dunnage strip 34. The terms "upstream" and "downstream" are used herein to refer to the flow of the stock material through the converter 30, from the upstream end 50 of the converter to the downstream end 56.

Figure 2:
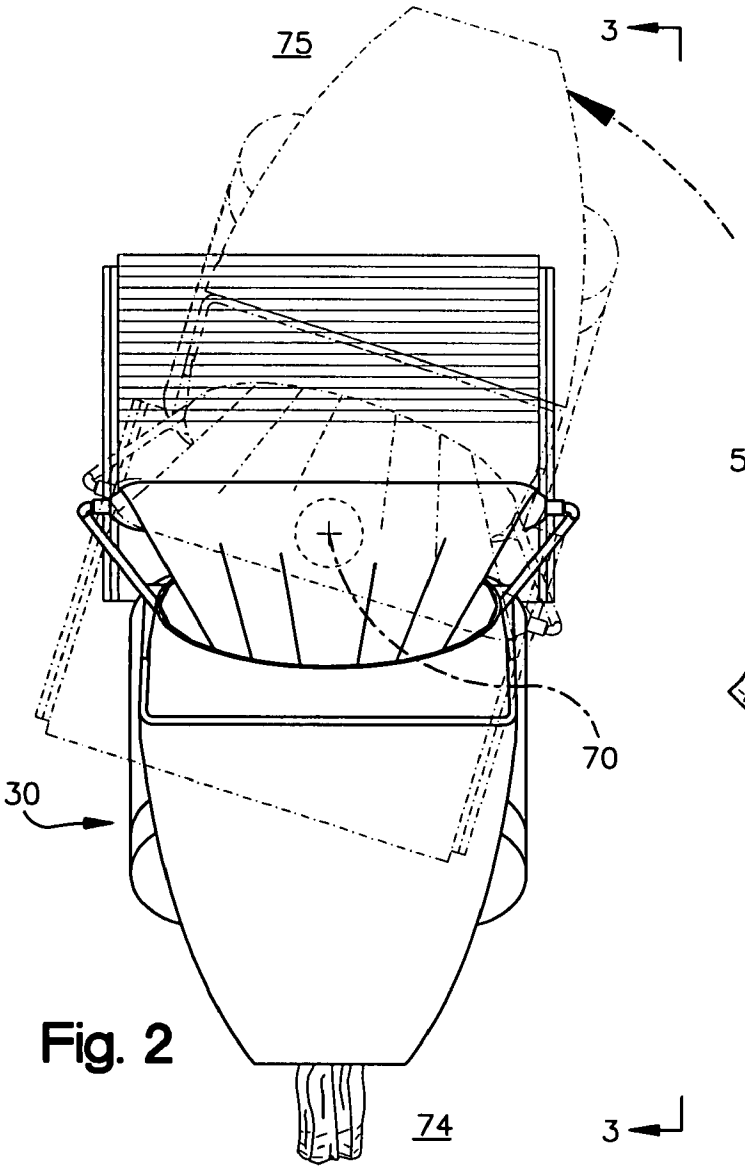
FIG. 2 is a top view of the converter shown in FIG. 1 that illustrates its rotation about a substantially vertical axis.

As illustrated in FIG. 1, the adjustable stand 40 supports the converter 30 on the table 36 to deliver dunnage products at a location immediately above a packing surface 66 of the table 36, such as, for example, directly into the container 41 resting atop the packing surface 66. The stand 40 allows the packer to orient the converter 30 so that the converter 30 discharges discrete dunnage products exactly where the packer wants them. Specifically, the stand 40 allows the packer both to rotate the converter 30 about a substantially vertical axis and to pivot the converter 30 about a substantially horizontal axis. The illustrated stand also allows the packer to raise and lower the height of the converter 30. This adjustability provides several advantages. As illustrated in FIG. 2, rotating the converter 30, for example, allows multiple packers, spaced around the vertical rotation axis of the stand 70 at separate packing stations 74 and 75, to use the same converter. That is, the converter can be swung back and forth between the two packing stations as needed. Rotation of the converter about a horizontal axis allows for changing the angle at which the dunnage product exits the converter 30 relative to the packing surface. In addition, the height of the stand can be adjusted to raise and lower the converter, as may be desirable to accommodate different ranges of box sizes, for example.

The illustrated stand 40 provides this adjustability and includes a base 76 and an upper part 77 mounted to the base 76. As shown, the upper part and base respectively have upright members 89 and 90 that are telescopically interconnected for adjusting the height of the upper part 77 relative to the base 76. This can be accomplished by the illustrated pin-and-hole arrangement, or any other arrangement for holding the converter 30 at different heights. The illustrated pin-and-hole arrangement allows a packer to raise and lower the converter 30, for example, between a height of about 40 cm (about 16 inches) and a height of about 70 cm (about 28 inches).

Figure 3:
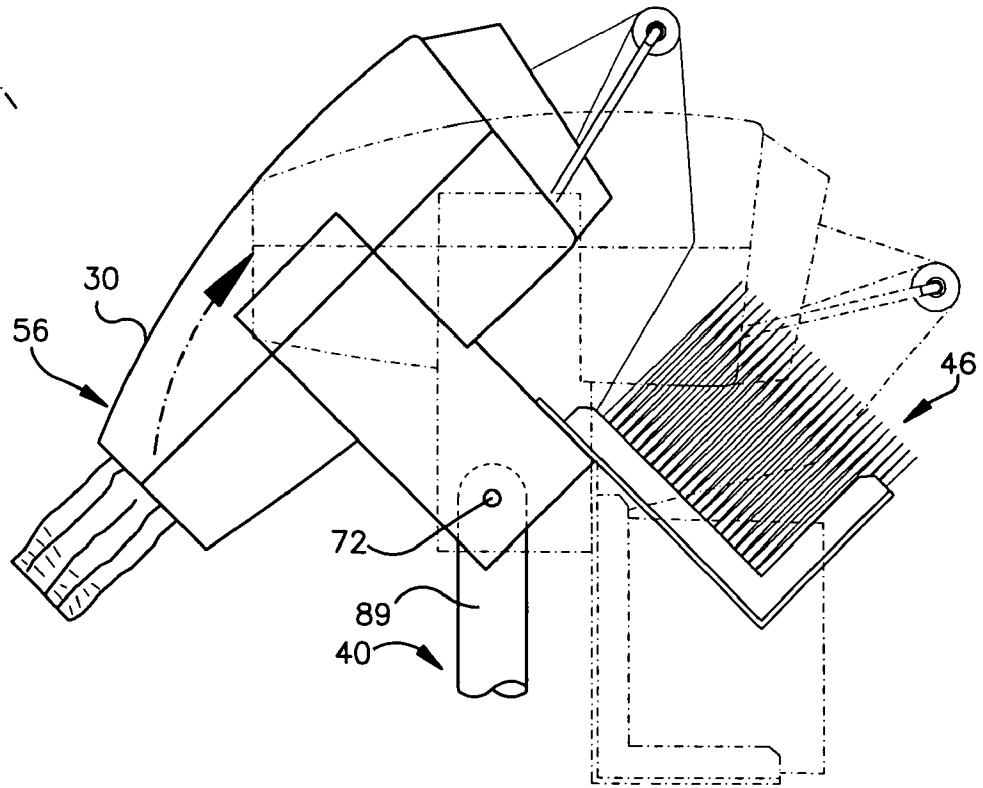
FIG. 3 is a partial side view of the converter that illustrates its pivotable movement about a substantially horizontal axis, looking along line 3—3 of FIG. 2.

The converter 30 is pivotally mounted to an upper end of the upper part 77 for rotation about a substantially horizontal pivot axis 72, as shown in FIG. 3. In the illustrated embodiment, the converter 30 is pivotally mounted directly to the upper end of the upright member 89 to allow the converter, and the stock supply assembly 46 that pivots therewith, to assume a more horizontal orientation, as depicted in broken lines. This may be desired for some applications. In the illustrated embodiment, the converter 30 can pivot between a substantially horizontal orientation and an orientation with the downstream end 56 of the converter 30 pointing approximately sixty degrees below horizontal.

The base of the stand can have different configurations, and preferably is configured for conveniently supporting the converter 30 on a table. The base 76 of the stand 46 illustrated in FIG. 1 includes a U-shape foot 94 from which the upright member 90 extends to support the converter 30 in a freestanding configuration. The foot 94 can project forwardly from the upright member 90 as is desired to counterbalance any forward offset of the converter's center of gravity, particularly when the stock supply in the stock supply assembly 46 is spent or almost spent.

Figure 4:
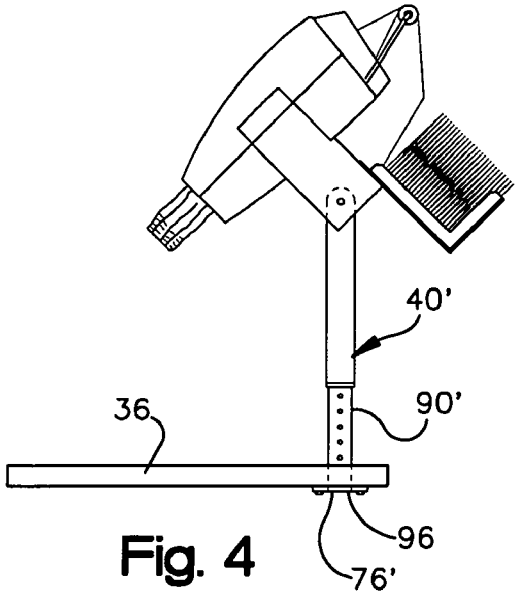
FIG. 4 is a side view of a converter mounted on another tabletop stand according to the present invention.

In FIG. 4, a different mounting scheme is illustrated. The base 76' of the illustrated stand 40' includes a mounting plate 96 at the bottom of the upright member 90' for permanently attaching the stand 40' to the top of a table 36. The mounting plate 96 can be provided with one or more fastener holes for securing the plate to the top side or underside of the tabletop.

Figure 5:
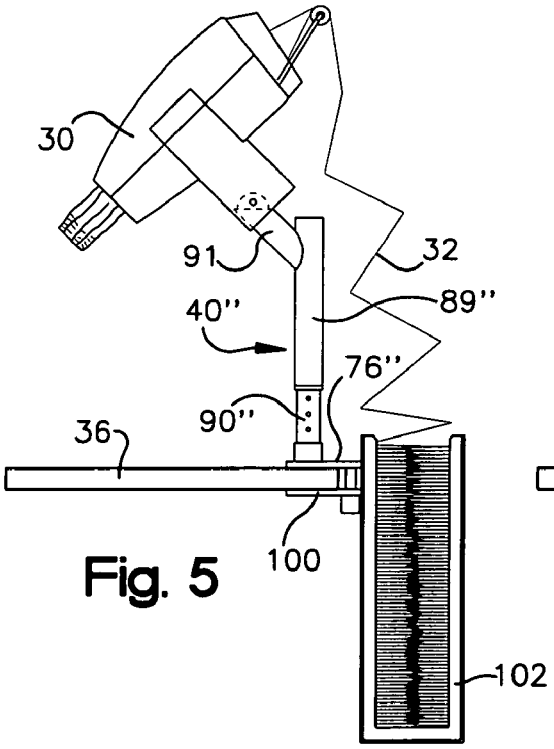
FIG. 5 is a side view of a converter mounted on yet another tabletop stand according to the present invention.

In FIG. 5, another mounting scheme is illustrated. In this embodiment of the stand 40", the upper part 77" has an inclined arm 91 extending upwardly from the upright member 89", and the converter 30 is pivotally mounted to the end of the inclined arm. The inclined arm 91 offsets the converter 30 more forwardly from the stand 40", and also increases the horizontal swing radius of the converter as may be desired when servicing two packing stations, as illustrated in FIG. 2. Such an upright member 89" can be substituted for the upright member 89 of the stand 40 in the embodiment shown in FIG. 1. The base 76" of the illustrated stand 40" includes a clamp 100 at the bottom of the upright member 90" for attaching the stand 40" to a tabletop. The clamp can be attached at an edge of the tabletop 36. As seen in FIG. 5, the clamp 100 also can support a device for supporting a supply of stock material, such as a magazine 102 that holds one or more units (bags, boxes, rolls, stacks, etc.) of stock material 32.

Figure 6:
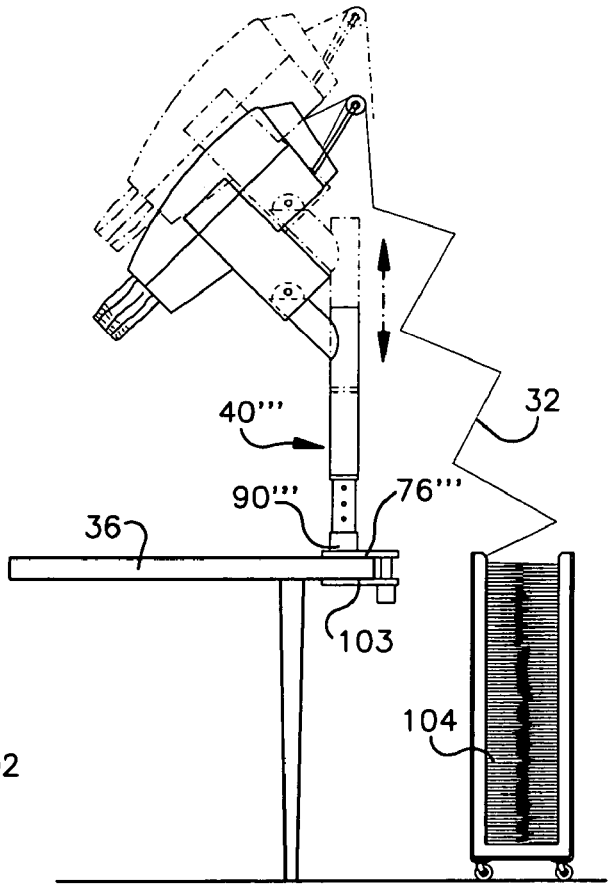
FIG. 6 is a side view of a converter mounted on yet another tabletop stand according to the present invention.

In FIG. 6, another manner of supporting a supply of stock material is illustrated. The base 76'" of the illustrated stand 40'" includes a clamp 103 at the bottom of the upright member 90'" for attaching the stand to a tabletop 36. The clamp 103 is similar to the clamp 100 shown in FIG. 5, but the clamp 103 in this embodiment does not support a supply of stock material. The supply of stock material is separate, and can be supported in a trolley 104, as shown in FIG. 5, for example.

Returning to FIG. 1, a supply of stock material is shown supported by the stock supply assembly 46, which is mounted for movement with the converter 30. The stock supply assembly is in the form of a tray having a shelf 106 mounted to the converter housing 42 to move the supply of stock material with the converter housing 42. Thus, the orientation or position of the converter 30 can be changed by the packer without having to separately move the supply of stock material. For example, rotating the converter 30 about the vertical axis 70 (FIG. 2) does not require the packer to take any further action to reposition the stock supply assembly 46.

The stock supply assembly 46 supplies the conversion assembly described below with one or more plies of sheet stock material 32, which typically consists of paper, specifically kraft paper, and preferably about fifteen inch (about thirty-eight centimeters) wide kraft paper. A paper dunnage product is an environmentally responsible protective packaging material; paper is recyclable, reusable and composed of a renewable resource. Other sheet materials can be suitable alternatives to paper, however.

The stock material 32 preferably is perforated or otherwise weakened in regions that extend across its width and are spaced apart along the length of the stock material. These weakened regions make it easier to separate the dunnage products from the strip of dunnage 34 and provides a cleaner separation. The stock material 32 typically is supplied as a stack of continuous fan-folded sheet material that is perforated at the folds. Alternatively, the stock material 32 can be perforated or otherwise weakened during the conversion process, either before or after it is formed into a strip of dunnage 34.

Figure 7:
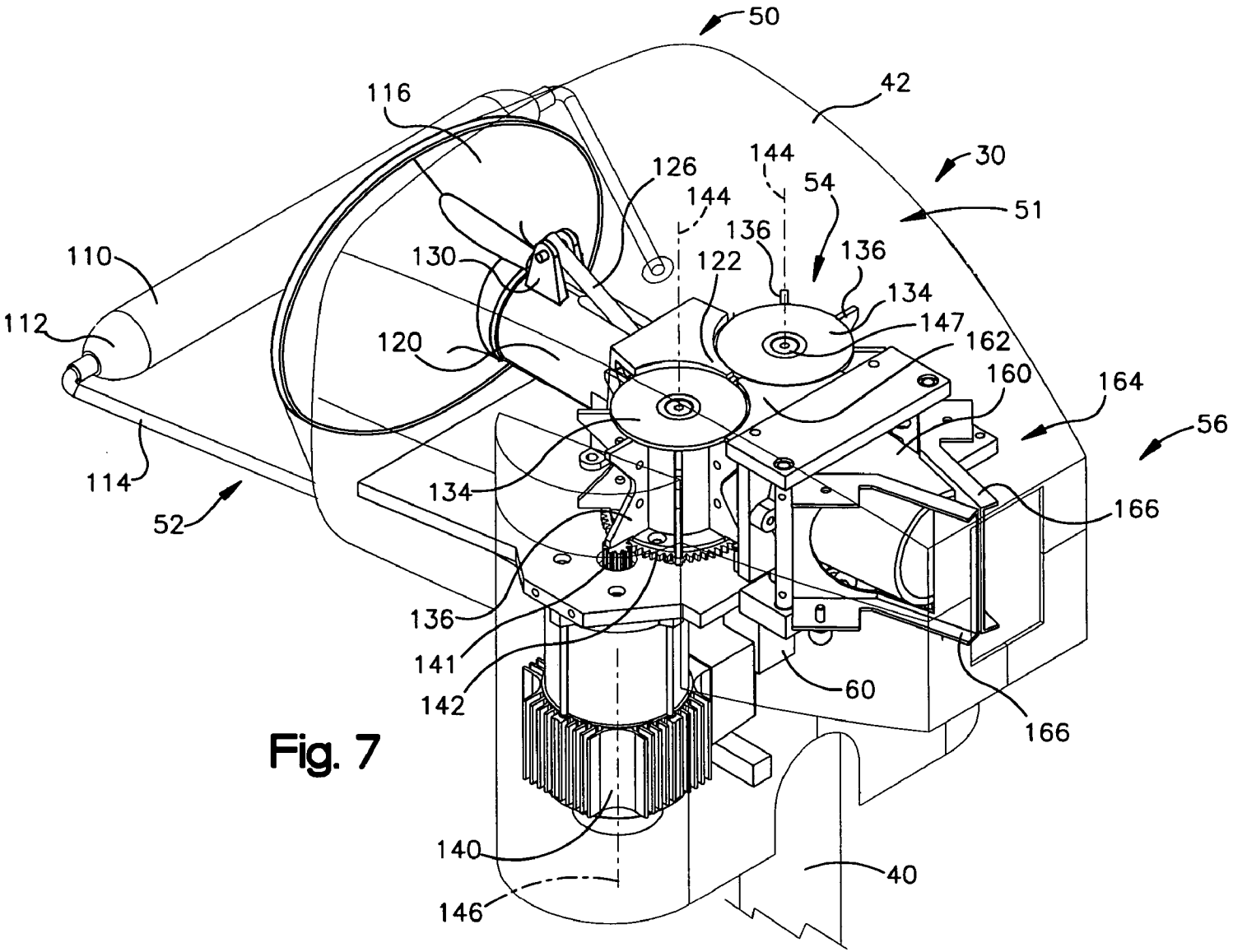
FIG. 7 is an enlarged front perspective view of the converter with the converter housing rendered transparent to show the internal components.
Figure 8:
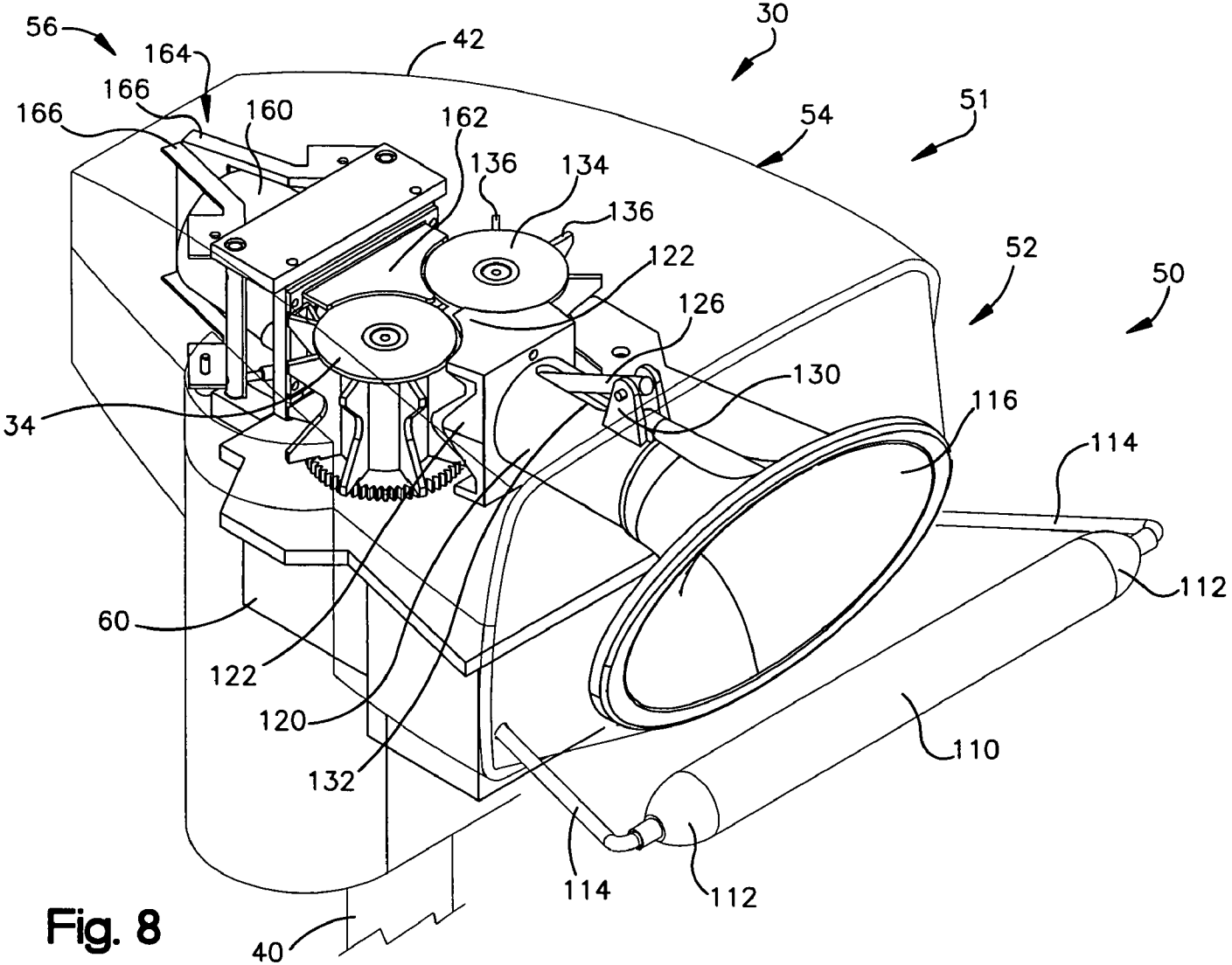
FIG. 8 is a rear perspective view of the converter, again with the converter housing rendered transparent to show the internal components.

Returning now to FIGS. 7–9, the internal components of the converter 30 will be described in greater detail. The converter 30 includes a conversion assembly 51 for converting the stock material supplied from the stock supply assembly 46 (FIG. 1) into a strip of dunnage. The illustrated conversion assembly 51 generally comprises a forming assembly 52 downstream of the stock supply assembly 46, and a feeding assembly 54 downstream of the forming assembly 52. The feeding assembly 54 pulls the stock material from the stock supply assembly and through the forming assembly. The forming assembly 52 inwardly gathers and crumples the stock material 32 into the shape of a generally round strip. Operation of the feeding assembly 54 is controlled by a controller 60 that can be located remotely or, as shown, mounted in the housing 42.

In the illustrated embodiment, a constant-entry member or guide 110 mounted at the upstream end of the housing 42 defines a substantially constant entry point for the stock material 32 entering the forming assembly 52 as the feeding assembly 54 draws the stock material through the conversion assembly. The illustrated constant-entry member 110 has rounded end portions 112 that taper inwardly toward outer ends of the member to allow the constant-entry member 110 to define an at least partially convex surface over which the feeding assembly 54 draws the stock material 32.

A pair of arms 114 support the illustrated constant-entry member 110 for movement between a first position in the path of the stock material 32 for normal operation, and a second position (shown in phantom lines in FIG. 9) out of the path of the stock material 32 to make it easier for a packer to feed a leading end of the stock material 32 into the converter 30 when the converter is being loaded.

From the constant-entry member 110, the stock material 32 flows through a gathering chute 116 that forms part of the forming assembly 52. The gathering chute, which has a funnel shape in the illustrated embodiment, inwardly gathers and crumples the stock material 32 as the stock material is being pulled through the gathering chute. The converging guide surfaces of the gathering chute define a progressively smaller cross-sectional area whereby the stock material is turned in on itself and crumpled to form a strip of dunnage having generally longitudinally extending crumpled lobes. The chute can have an oval or circular cross-sectional shape and provides a smooth transition for the stock material 32 without any sharp edges that might cause tearing of the stock material.

Figure 13:
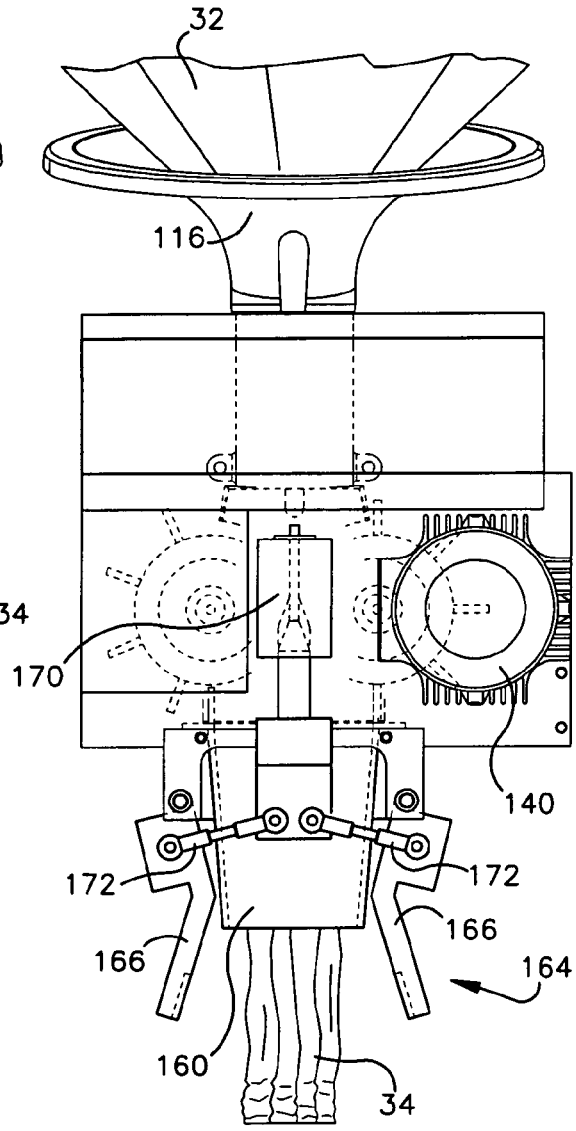
FIG. 13 is a bottom view of the internal components of the converter, looking along line 13—13 of FIG. 9.
Figure 14:
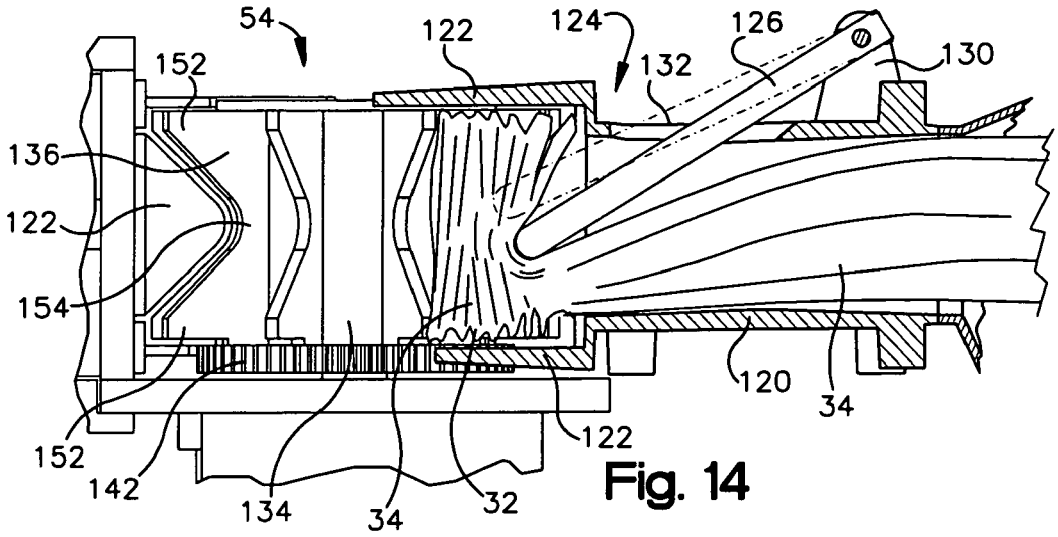
FIG. 14 is an enlarged cross-sectional view of a "check valve" portion of the converter, looking along line 14—14 of FIG. 12.

From the gathering chute 116, the crumpled strip of stock material 32 flows through an inlet guide chute 120 that can form a continuation of the narrow end of the gathering chute 116. The inlet guide chute guides the stock material 32 to the feeding assembly 54. In the illustrated embodiment, the guide chute 120 is generally tubular and has a diameter at an upstream end that is about equal to the adjacent downstream end of the gathering chute 116. This portion of the guide chute 120 circumferentially constrains the stock material passing therethrough. At a downstream end of the inlet guide chute 120, the chute has one or more flanges or fingers 122 that correspond to the shape of the upstream end of the feeding assembly 54. The inlet guide chute 120 thus defines a continuous path for the flow of sheet stock material 32 from the gathering chute 116 to the feeding assembly 54. As shown in FIGS. 13 and 14, these flanges 122 help form a space at the downstream end of the inlet guide chute 120 that is larger than the tubular portion of the guide chute 120 in the illustrated embodiment.

The inlet guide chute 120 has an upstream restraining device 124, also referred to as a reverse-blocking member or stop, that cooperates with the inlet guide chute 120 to form in essence a check valve upstream of the feeding assembly 54. The upstream restraining device 124 is referred to herein as the "check valve." The check valve 124 allows the stock material 32 to flow in a downstream direction through the inlet guide chute 120 to the feeding assembly 54 when the feeding assembly is being operated to move the stock material in a forward direction. When the feeding assembly is operated to move the stock material in a reverse direction, the check valve 124 inhibits or prevents the stock material 32 from significantly moving through the inlet guide chute 120 in an upstream direction.

The illustrated check valve 124 includes a rod or arm 126 pivotally mounted to a bracket 130 at a point above the inlet guide chute 120. The stop arm 126 is biased downwardly by gravity. Alternatively or additionally, a spring or other resilient force can be applied to the stop arm. As a further alternative, the stop arm can be moved by an actuator between a position allowing passage of the stock material in the forward direction and a position precluding any significant passage of the stock material in the reverse direction.

The illustrated stop arm 126 extends in a downstream direction from the pivot point into the inlet guide chute 120 into through a longitudinally-extending slot 132. As the stock material 32 flows in a forward or downstream direction, the free end of the stop arm 126 will ride along the crumpled strip of stock material 32 as the latter flows through the inlet guide chute 120. When the feeding assembly 54 operates to move the stock material in a reverse direction, however, the end of the stop arm 126 will be urged downwardly by engagement with the crumpled strip as it moves toward the inlet guide chute 120, thereby blocking the inlet guide chute 120 and preventing the stock material 32 from moving upstream through the chute 120 by any significant amount. Instead, the stock material 32 will be longitudinally compressed between the feeding assembly 54 and the stop arm 126. The resiliency of the stock material 32 will maintain the stock material in engagement with the feeding assembly 54, so that when the feeding assembly 54 again operates to move the stock material in the forward direction, the feeding assembly 54 will move the stock material 32 therethrough without an operator's intervention.

Without the check valve 124, if the location downstream of the feeding assembly 54 where the strip of dunnage separates is unknown, the feeding assembly 54 might push the stock material 32 upstream through the inlet guide chute 120 to a location out of reach of the feeding assembly 54. Then, when the feeding assembly 54 attempts to feed the stock material 32 in a forward direction, the feeding assembly 54 would not engage the stock material 32. This would require the operator to thread the stock material 32 through the feeding assembly 54 until once again engaged by the feeding assembly.

The illustrated feeding assembly 54, shown in FIGS. 9–14, has a pair of opposed feed members 134 that include grippers 136. The grippers 136 engage the strip of dunnage 34 on generally opposite sides to pull the stock material 32 from the stock supply assembly 46 (FIG. 1) and through the forming assembly 52.

In the illustrated embodiment the grippers 136 are translated along a circular path on opposite sides of the path of the stock material when the feed members 134 are rotated. As is preferred, the feed members 134 have a configuration similar to a pair of paddle wheels. These paddle wheels 134 are driven by a motor 140, for example, a rotary electric motor 140 and corresponding gears 141, 142 in a gear train. The axis 144 of the paddle wheels 134 generally extends in a direction that is parallel to an axis 146 of the shaft of the motor 140. The controller 60 controls operation of the motor 140, which in turn controls the operation of the feeding assembly 54 to move the stock material in both forward and reverse directions.

The opposing sets of grippers 136 are uniformly circumferentially spaced apart on the paddle wheels 134. The paddle wheels 134 have respective axles 147 about which they rotate. Each gripper 136 has a somewhat V-shape or outwardly opening aperture 150 in the side thereof. On opposite sides of the outwardly opening aperture 150 are contact portions formed by arms 152 that define the V-shape opening 150 with a base or central contact portion 154 bridging the arm portions or side contact portions 152. The apertures 150 formed by the opposing sets of grippers 136 together form a through-gap or channel that gradually narrows as the grippers 136 progressively move toward each other as the paddle wheels 134 rotate. The narrowing of the gap between the grippers 136 eventually reaches a minimum gap size. In other words, the arm portions 152 and the base portions 154 move transversely toward or "close in" on each other to grip the strip 34 therebetween.

Once the opposing grippers 134 engage the strip of dunnage 34, the grippers 136 maintain a grip on the strip 34 for the duration of their travel along the path of the stock material through the feeding assembly 54. At the downstream end of the feeding assembly 54, the opposing sets of grippers 136 gradually diverge away from each other to release the strip of dunnage 34.

The grippers optionally can have teeth for engaging or perforating the stock material therebetween. Although the illustrated embodiment shows two sets of grippers arranged to form a pair of paddle wheels, a single set of grippers that form a single paddle wheel and an opposed guide trough (not shown) can be used to move the stock material through the converter. In this arrangement, the opposed guide trough forms a stationary gripper. As alternatives to the illustrated grippers, other grippers may have any shape or have different shapes between grippers of the same or different paddle wheels.

As but one alternative to the illustrated feeding assembly 54, the feeding assembly can have a pair of transfer assemblies with flexible drive elements to which grippers are attached. For further details on such transfer assemblies, see International Patent Application No. PCT/US01/18678 filed Jun. 8, 2001 and published as Publication No. WO0194107 on Dec. 13, 2001, the entire disclosure of which is incorporated herein by reference. Features disclosed herein in relation to the rotatable feed members are equally applicable to these translating transfer assemblies.

From the feeding assembly 54, a downstream or outlet guide chute 160 guides the strip of dunnage 34 out of the converter 30. The downstream guide chute 160, like the upstream or inlet guide chute 120, also includes one or more flanges or fingers 162. Like the flanges on the inlet guide chute 120, the fingers 162 have a shape that compliments the shape of the downstream end of the feeding assembly 54, namely the outwardly opening apertures 150 of the grippers 136. As a gripper 136 diverges away from a gripper on the opposing paddle wheel 134 to release the strip of dunnage 34, the gripper 136 sweeps by the corresponding guide finger 162 and receives the guide finger 162 in its outwardly opening aperture 150, causing the gripper 136 and finger 162 to match up and passing the strip of dunnage 34 to the outlet guide chute 160 (see FIG. 14). The guide chute 160 guides the strip of dunnage 34 downstream and prevents the strip of dunnage 34 from straying from the desired path as the strip 34 flows from the feeding assembly 54 through the downstream guide chute 160. In fact, the illustrated downstream guide chute 160 gradually narrows to funnel the strip of dunnage 34 and more tightly control its movement as it progresses downstream.

Figure 9:
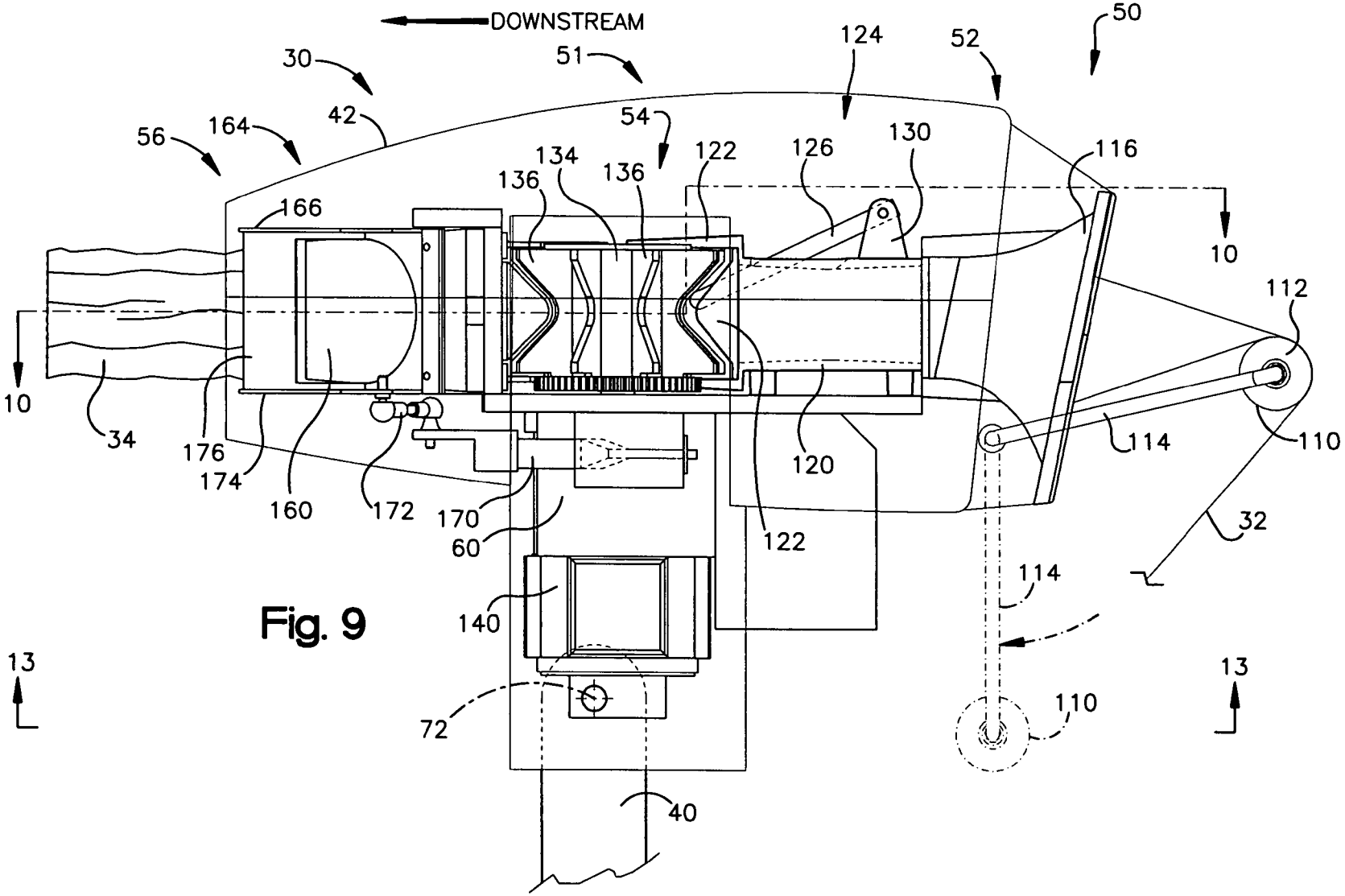
FIG. 9 is a side view of the converter, showing the feeding of stock material therethrough.
Figure 10:
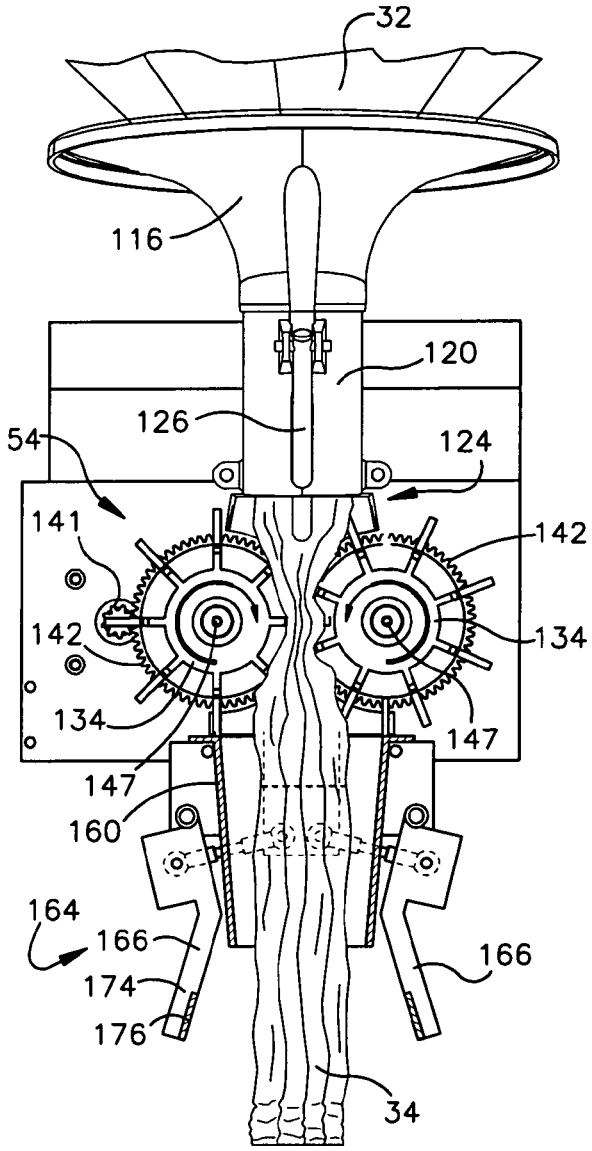
FIGS. 10–12 are sequential top views of the internal components of the converter that illustrate the operation of the interior components of the converter, looking along line 10—10 of FIG. 9.

To effect automatic separation of a dunnage product from the strip 34, the converter 30 illustrated in FIGS. 9–12 also includes a capture device or holder 164, also referred to as a downstream restraining device. The holder 164 captures and holds a leading section of the strip 34 at a holding location downstream of the feeding assembly 54 to help separate the leading section from the rest of the strip 34. The illustrated holder 164 has at least one restraining member 166 that is movable between a position that allows the stock material 32 to pass in a forward or downstream direction (FIG. 9), and a position that restricts substantial reverse movement of the stock material 32 at the holding location downstream of the feed assembly 54 (FIG. 10).

As is preferred, the holder 164 includes a pair of restraining members 166 that are pivotally mounted on opposing sides of the downstream guide chute 160, and are forcibly moved into the path of the stock material 32 to engage the strip of dunnage 34 at the holding location. In the illustrated embodiment, a common actuator, such as a solenoid 170, moves the restraining members 166 through respective linkages 172. The controller 60 controls operation of the actuator 170, and thus the restraining members 166.

Each restraining member 166 pivots about a pivot axis, from which a pair of parallel, spaced apart pivot arms 174 extend to a grabber plate 176. The pivot arms 174 are spaced to reach around the downstream guide chute 160 so that the downstream end of the downstream guide chute 160 does not interfere with the movement of the restraining member 166. The restraining members 166 can optionally further include teeth (not shown) to help grab and hold the strip of dunnage 34.

When the feeding assembly 54 operates to move the stock material in a reverse direction, the holder or capture device 164 captures and holds the strip 34 at the holding location downstream of the feeding assembly 54. The restraining members come together, such as at an angle of approximately 30 degrees, so that the ends of the grabber plate 176 bite into and hold the dunnage strip 34 to inhibit or prevent significant movement of the stock material 32 at the holding location. Because the strip 34 has weakened regions, operating the feeding assembly 54 in reverse separates the strip 34 at a location at or between the restraining members 166 and the feeding assembly 54. If the strip 34 separates near the feeding assembly 54, the now free end of the strip 34 is pushed upstream of the feeding assembly 54. If the strip 34 separates near the holding location, a significant amount of the strip 34 may be pushed upstream of the feeding assembly 54, but the strip 34 may still extend therethrough.

Once a dunnage product has separated from the strip 34, the restraining members 166 can release the dunnage product to the packer. Typically, the controller 60 signals the solenoid 170 to move the restraining members 166 back to the position out of the path of the strip 34 after the feeding assembly 54 completes the predetermined reverse period.

To summarize: in operating the converter 30, the packer may depress a foot pedal (not shown) to cause the controller 60 to energize the drive motor 140 and drive the feeding assembly 54 to move the stock material 32 in a forward direction to produce a strip of dunnage 34 for as long as the pedal is depressed. As the stock material 32 flows through the forming assembly 52, the forming assembly 52 inwardly gathers and crumples the stock material 32 to form the strip 34. The feeding assembly 52 moves the strip 34 in a forward direction through the forming assembly 52, the feeding assembly 54 and the capture device 164 downstream of the feeding assembly 54 (as shown in FIG. 9). When the pedal is released, the controller 60 de-energizes the motor 140. This stops the feeding assembly 54. The controller 60 energizes the solenoid 170 and the capture device 164 engages and holds the strip 34 at the holding location downstream of the feeding assembly 54, as shown in FIG. 10.

Figure 11:
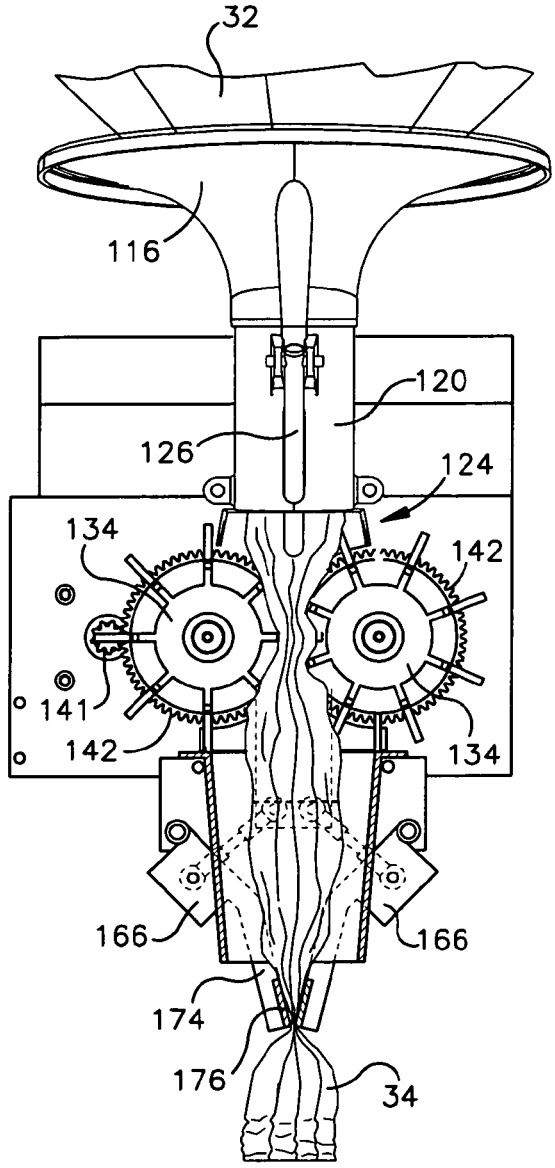
Figure 12:
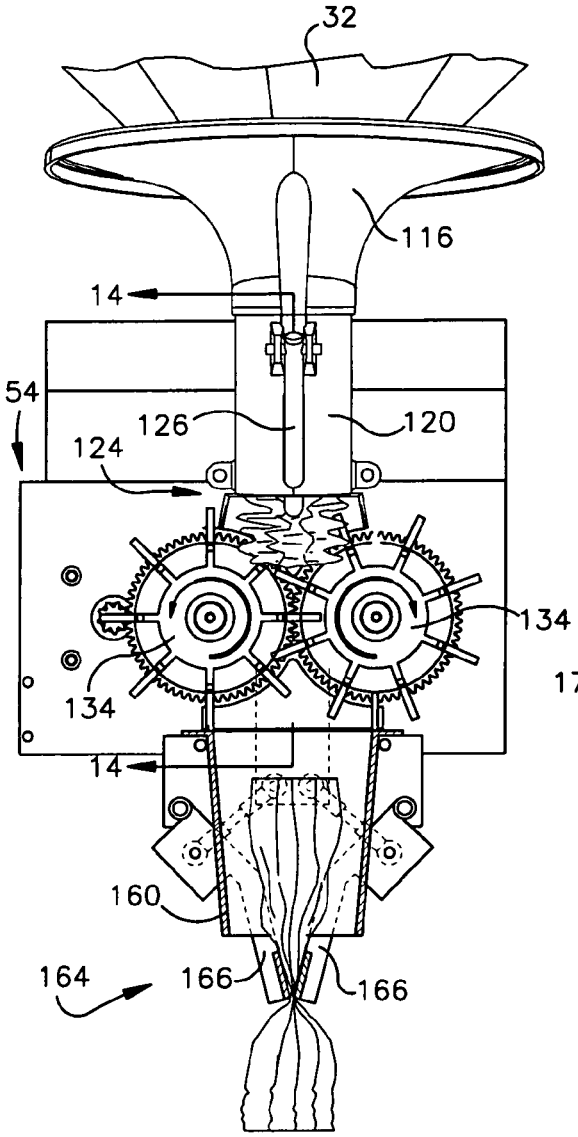

After energizing the solenoid 170, the controller 60 energizes the motor 140 to operate the feeding assembly 54 to move the stock material in the reverse direction. The feeding assembly 54 typically rotates the feed members 134 in reverse a predetermined amount (time or distance), such as through about 270 degrees. The feeding assembly 54 urges the strip of dunnage 34 away from the capture device 164, causing the strip of dunnage 34 to separate at a location at or downstream of the feeding assembly 54 and at or upstream of the capture device 164 as shown in FIG. 11. This frees a leading section of the strip 34, which forms a discrete dunnage product for removal and use. The solenoid 170 then opens the capture device 164 to release the leading end of the strip. And the converter 30 is ready to repeat the process.

Because of the resilience of the stock material 32 and the operation of the check valve 124 upstream of the feeding assembly 54, the feeding assembly 54 readily engages the stock material 32 once again without the operator intervening to manually thread the stock material into the feeding assembly 54. When the feeding assembly 54 is again driven in a forward direction, the just-separated dunnage product can be pushed out of the housing 42 (FIG. 9) by a succeeding length of dunnage directly to a packer at a desired location, such as the container 41 shown in FIG. 1.

Figure 16:
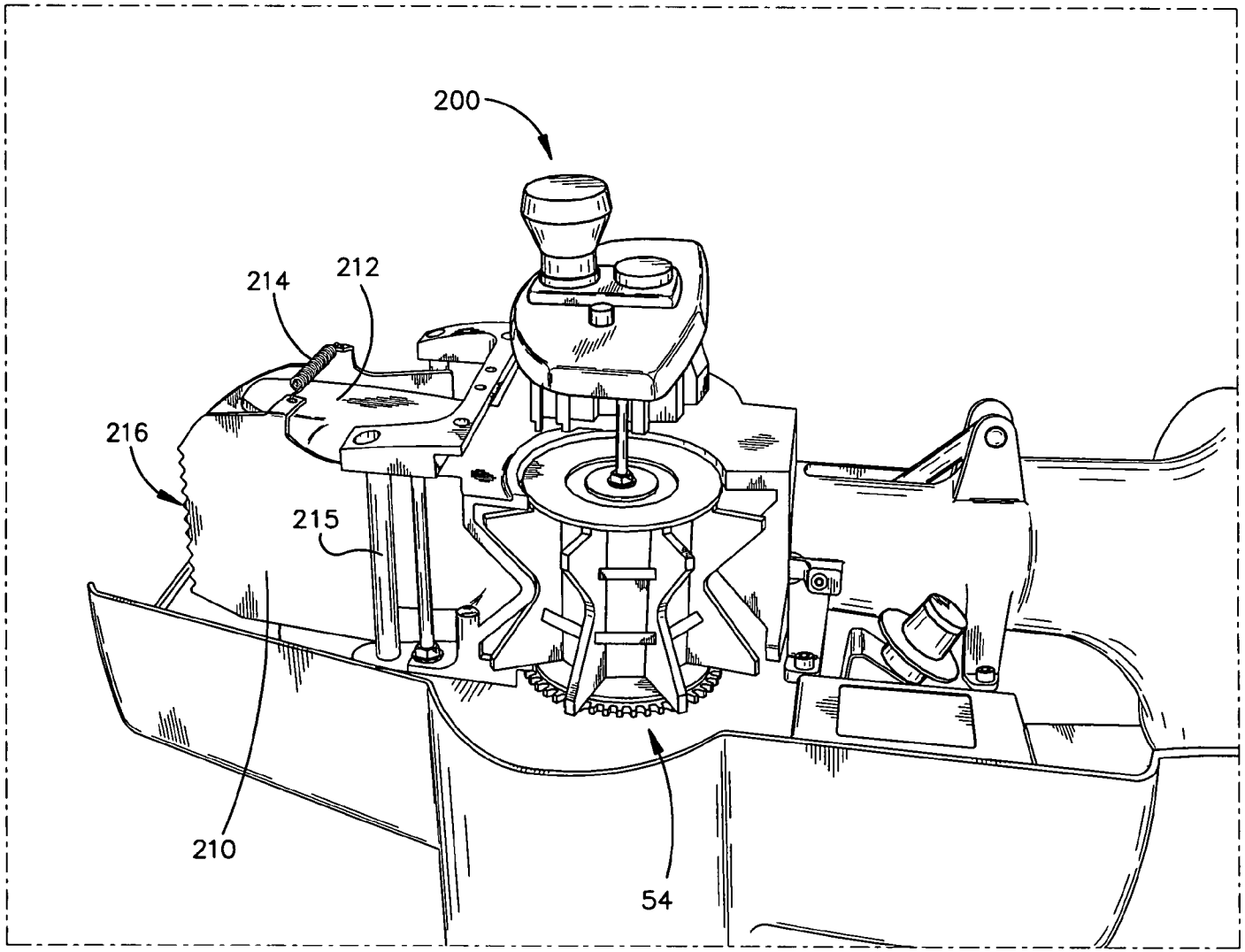
FIG. 16 is a side perspective view of another dunnage converter provided by the present invention with a top cover removed to show the internal components.

Another dunnage converter 200 provided by the present invention is shown in FIGS. 16–24. An overview of the converter 200, with an upper portion of the housing removed, is shown in FIG. 16. The converter 200 is essentially the same as the previously-described converter 34, except in the following respects. In particular, the downstream holder and downstream guide chute 212 have been modified, and an internal dunnage strip guide has been added. The changes are described below.

The downstream holder has been simplified by eliminating the powered actuator, including the solenoid, associated linkages and control devices. In the holder illustrated in FIG. 16, for example, the actuator is a spring 214. The spring 214, a tension spring in the illustrated embodiment, interconnects a pair of opposed restraining members 210 and resiliently biases the restraining members 210 toward a closed position. In the closed position, the gripping ends of the restraining members are adjacent one another, although not necessary in contact with one another as shown in the illustrated embodiment.

The illustrated restraining members 210 are formed of metal plates mounted for pivotable movement about axes 215 laterally disposed outside the downstream guide chute 212. The restraining members 210 preferably are longitudinally adjustable, as further discussed below, to provide different pivot axes.

Figure 17:
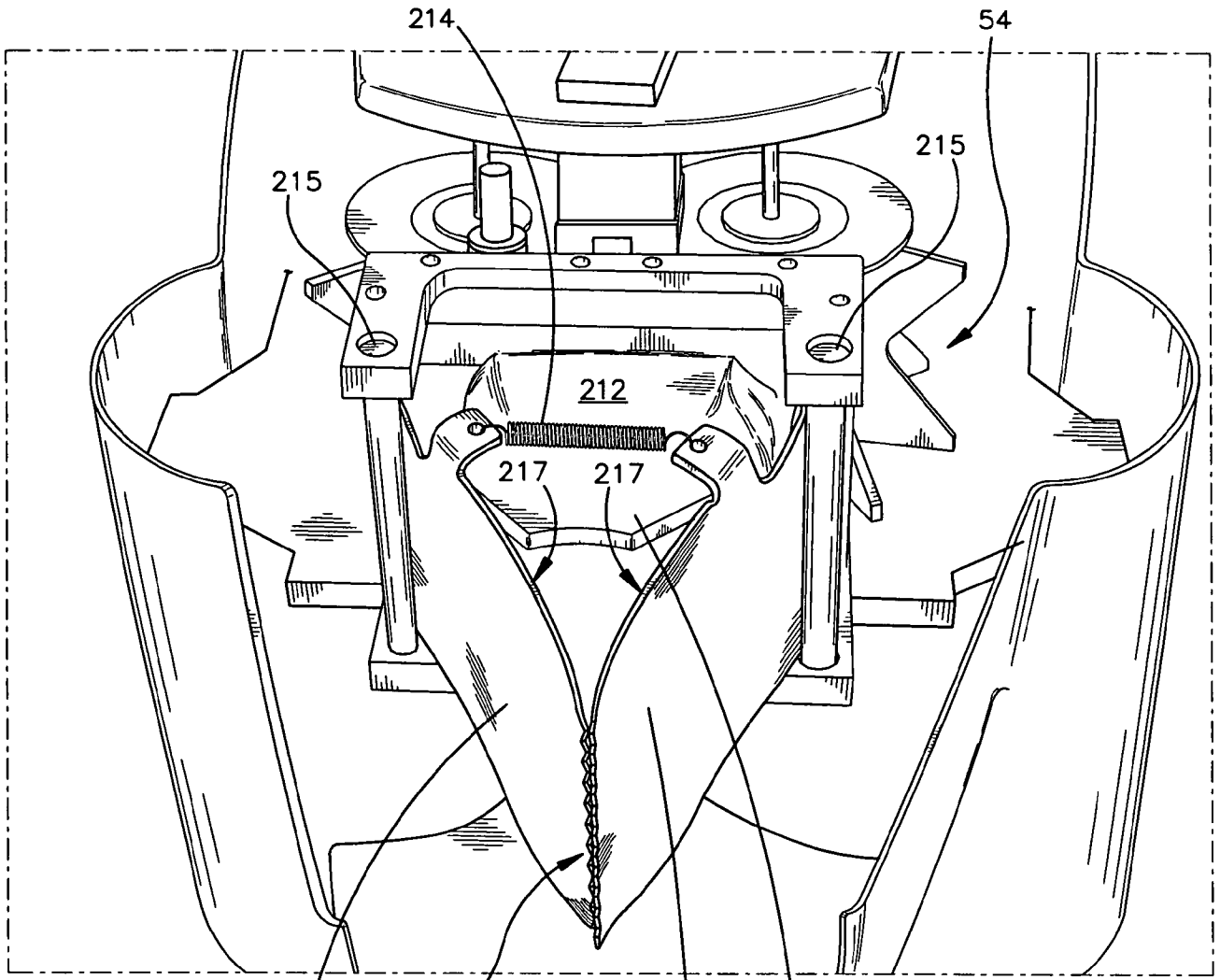
FIG. 17 is a front perspective view of a downstream end of the converter of FIG. 16.
Figure 18:
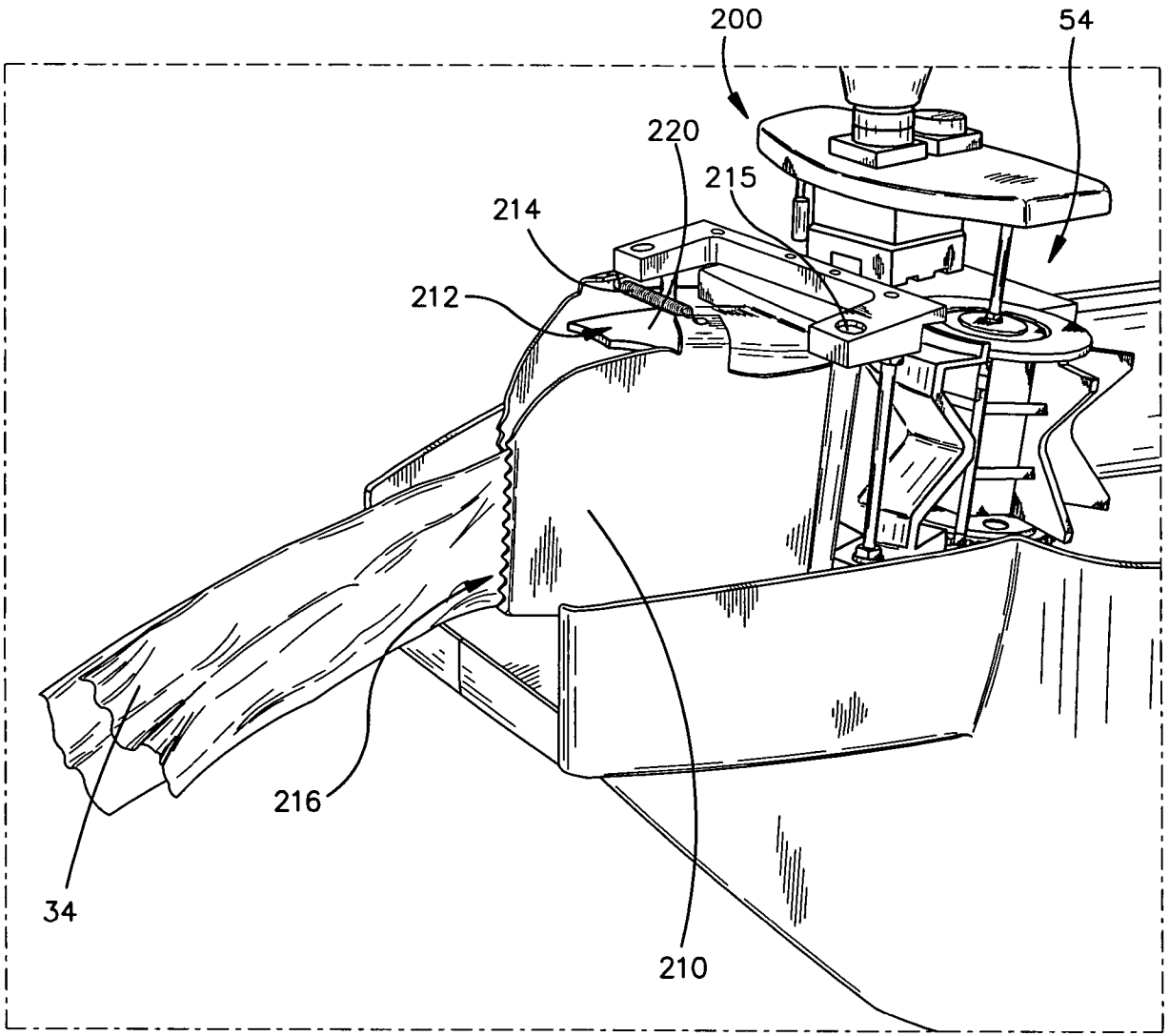
FIG. 18 is a side perspective view of the downstream end of the converter of FIG. 16 with a strip of dunnage extending therefrom.

The restraining members 210 curve inwardly to provide a camming portion 217 that extends toward the path of the strip 34 to engage the strip and cause the restraining members 210 to be moved outwardly by the strip 34 against the biasing force, as shown in FIG. 17. When the restraining members 210 are moved by the biasing force to locate the gripping ends thereof adjacent one another in the closed position, the camming portion is sloped relative to the path of the dunnage strip 34. As the dunnage strip 34 is produced and forwardly advanced, the leading end of the strip will engage the camming portion of the restraining members to urge them apart against the biasing force of the spring 214 to allow the dunnage strip to pass therebetween only in a forward direction.

As discussed above, the restraining members 210 coact to prevent reverse travel of the dunnage strip even when the feeding assembly 54 is reversely operated.

To aid in preventing reverse movement of the strip when the feed assembly is reversely operated, the restraining members 210 have teeth 216 that bite into the strip. The individual teeth 216 preferably are offset from one another, staggered such that the teeth are interlaced, as shown in FIG. 17, in the absence of a strip therebetween. The teeth 216 of each restraining member 210 are laterally staggered relative to the teeth of the other restraining member, such the tip of each tooth on each restraining member aligns with a valley formed between the teeth of the other restraining member.

Figure 15:
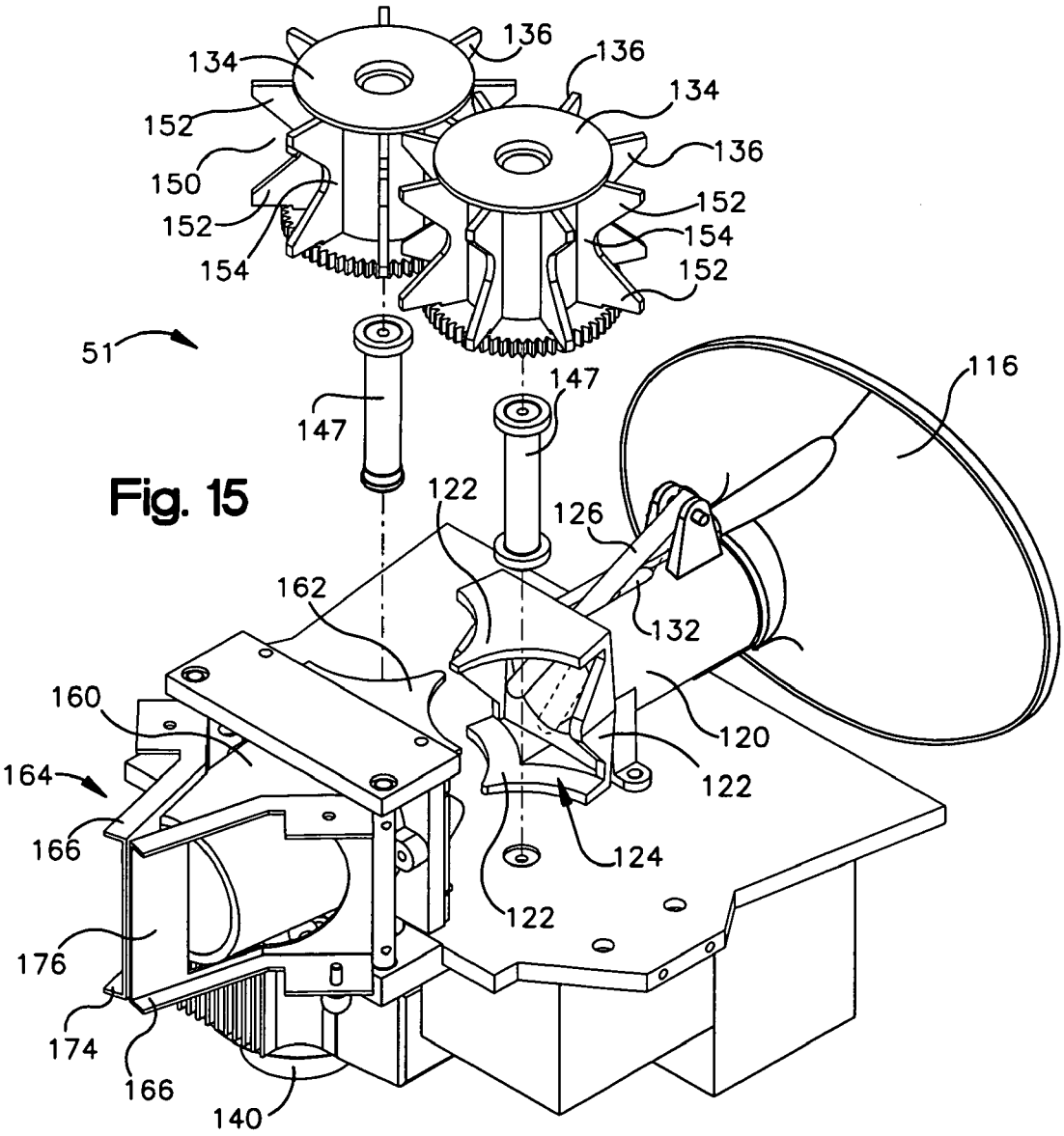
FIG. 15 is a partially exploded perspective view of the internal components of the converter, showing a pair of rotating feed members separated from the rest of the internal components.

The downstream guide chute 212 guides the strip between the restraining members 210. In contrast to the previously-described converging downstream guide chute 160 (FIG. 10, for example), the illustrated downstream guide chute 212 flares outwardly at the downstream end. Put another way, the cross-sectional area of the chute increases in a downstream direction. The illustrated guide chute 212 has a generally rectangular cross-sectional shape with the restraining members 210 generally squared to the sides of the chute. A circular tubular shape also could be used as shown in the embodiment of FIG. 15.

In the embodiment of FIG. 16, the sides of the guide chute 212 closest to the restraining members 210 end are shorter than the sides interposed therebetween. These longer sides form opposing extensions 220 of the guide chute 212. The illustrated restraining members 210 in effect provide a continuation of the guide chute and cooperate with the extensions 220 to guide the strip of dunnage therebetween.

The restraining members 210 preferably are longitudinally adjustable relative to the downstream end of the guide chute 212 to accommodate different types of stock material and different distances between perforations in the stock material. One or more cover plates can be attached to the shorter sides of the downstream guide chute 212 to extend the guide chute to accommodate different positions of the restraining members 210, if necessary.

The opposing extensions flare outwardly, away from each other. In the event of a jam, the flared guide chute 212 makes it easier for the feeding assembly 54 to clear the jam with succeeding portions of the strip 34.

Figure 19:
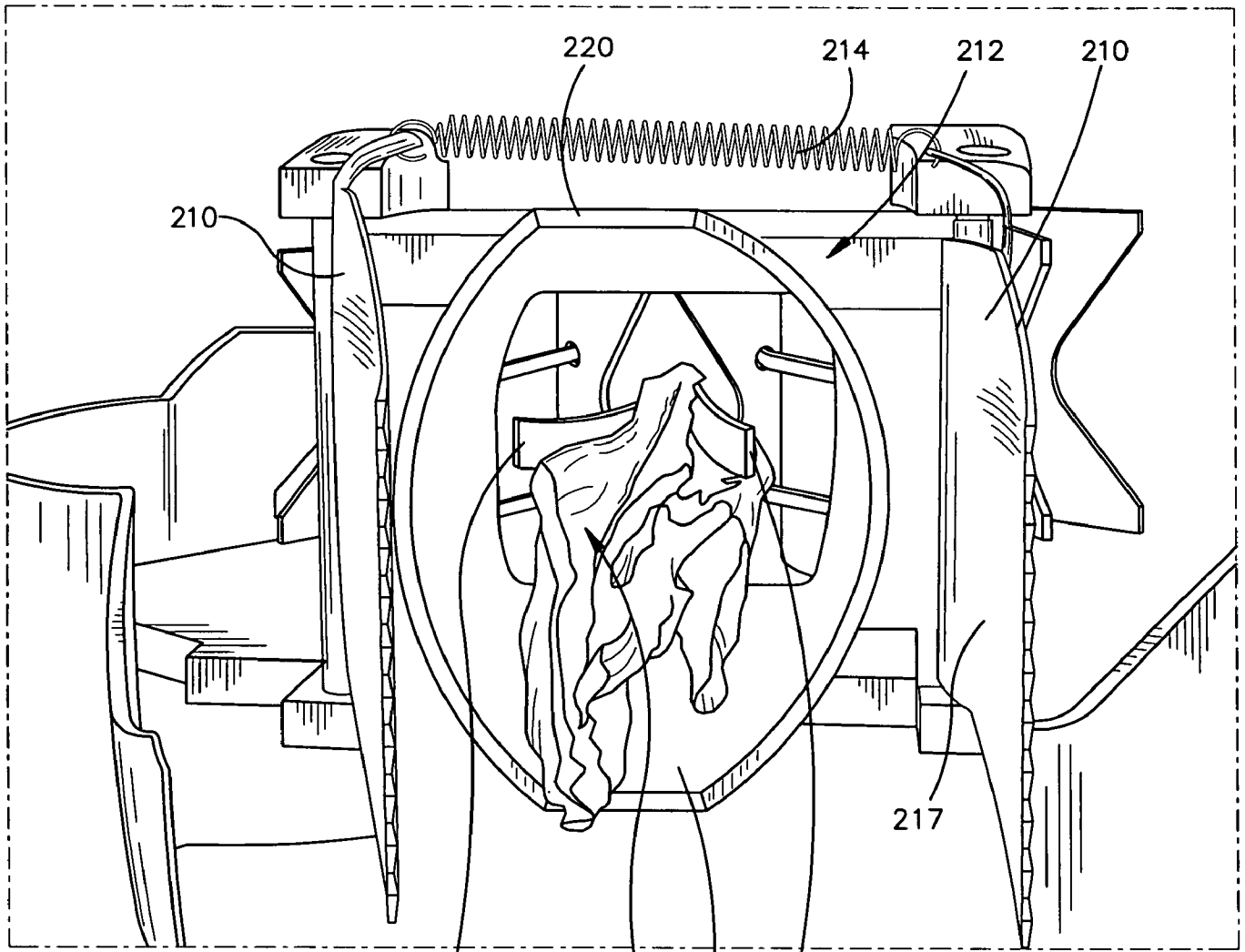
FIG. 19 is a downstream end view of the converter of FIG. 18 with a pair of restraining members held apart to show the strip of dunnage extending therefrom.
Figure 20:
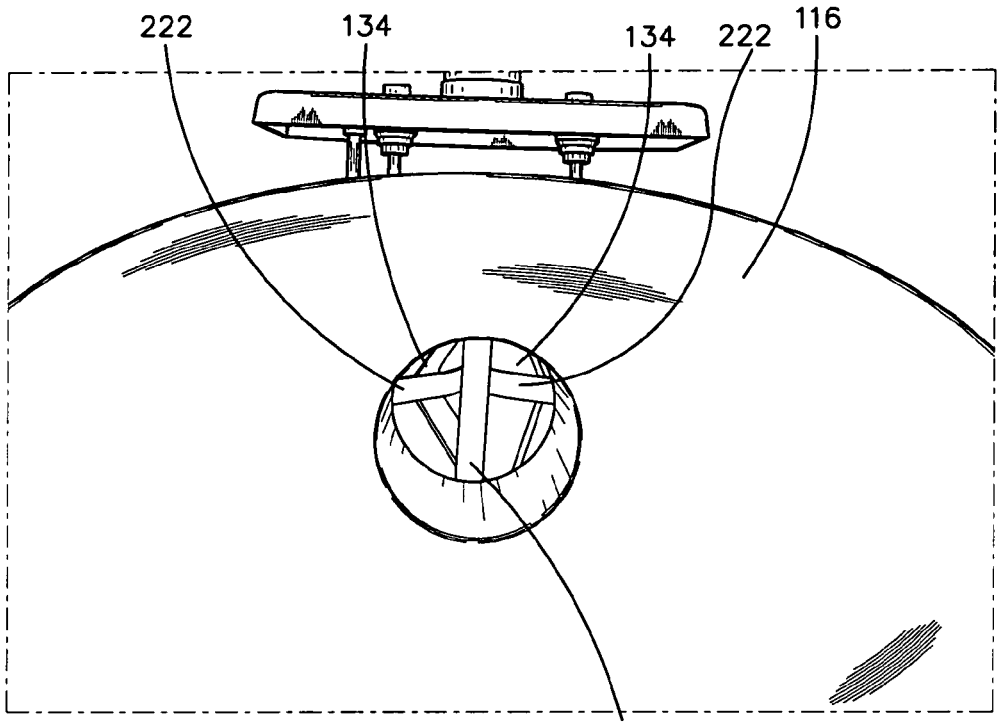
FIG. 20 is an upstream end view of the converter of FIG. 16.
Figure 23:
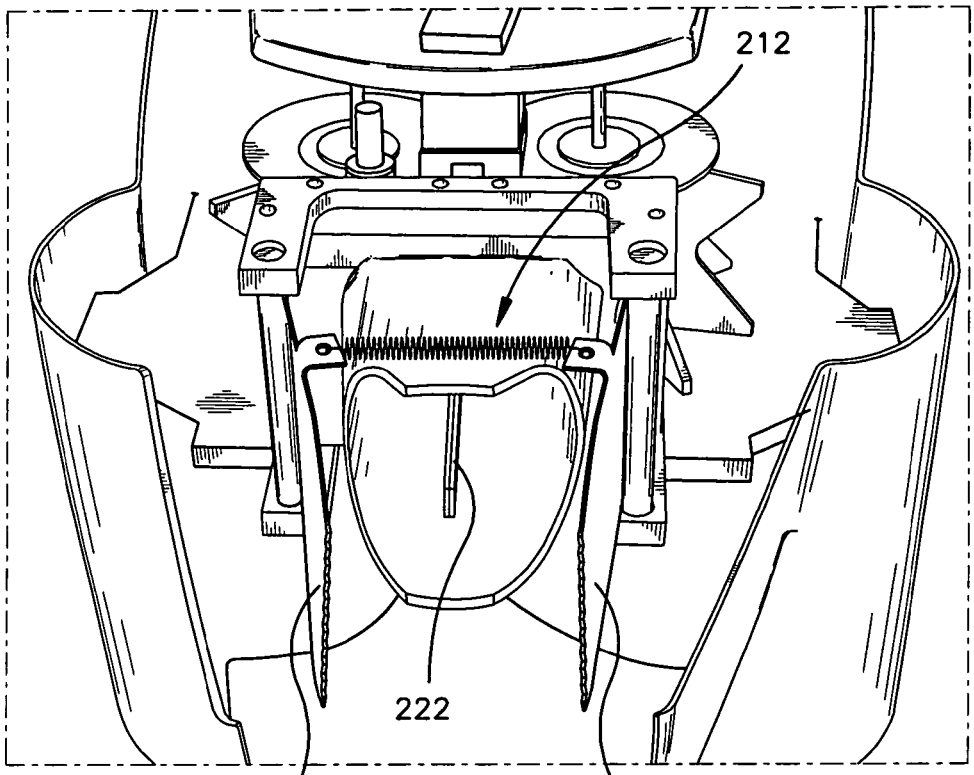
FIG. 23 is a front perspective view of the downstream end of the converter of FIG. 16 with a pair of restraining members held apart to show a pair of guide members provided by the present invention.
Figure 24:
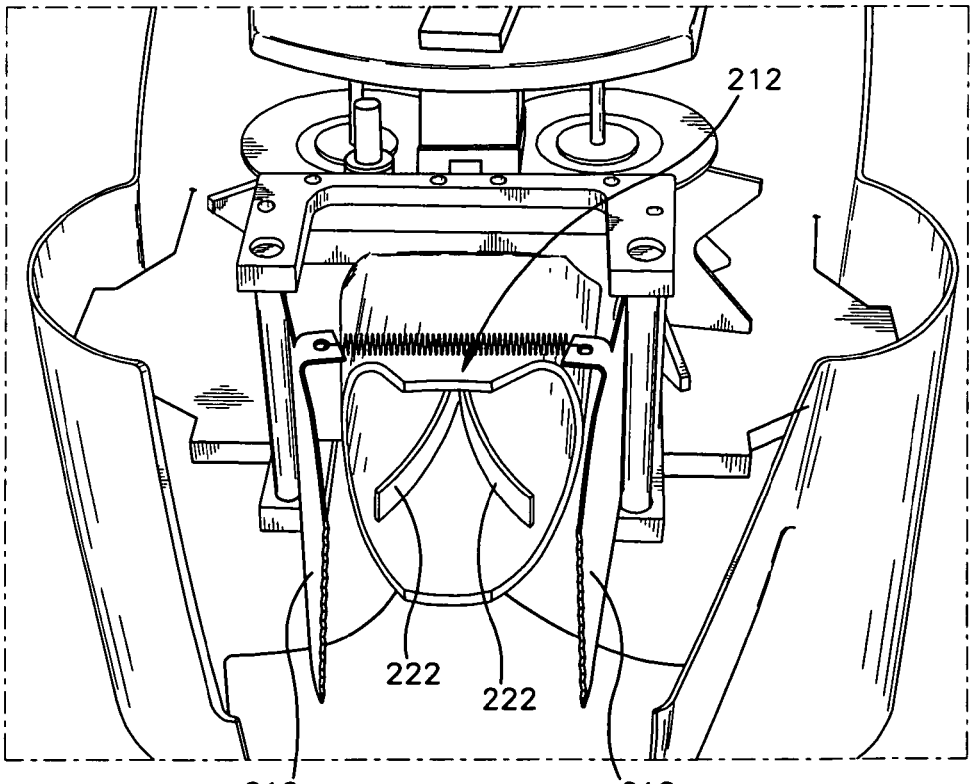
FIG. 24 is another front perspective view of the downstream end of the converter, similar to FIG. 23, with both the pair of restraining members and the pair of guide members held apart.

The converter 200 provided by the present invention also includes an internal guide, another device that prevents jams while providing other advantages. The internal guide includes one or more elongated guide members 222. In the illustrated embodiment, each guide member 222 has a generally rectangular cross-sectional shape, as shown in FIG. 19, although other shapes, including round, oval and triangular also could be used. The guide member 222 extends through the apertures in opposed grippers 136 of the feeding assembly 54 to guide the stock material past the feed members 134. Referring to FIGS. 23 and 24, looking downstream through the gathering chute 116, the arm 126 of the check valve 124 (FIG. 14) can be seen, along with the guide members 222 to the sides of the arm 126. The guide members 222 extend downstream through a gap 223 created by respective apertures of opposing feed members 134.

Figure 21:
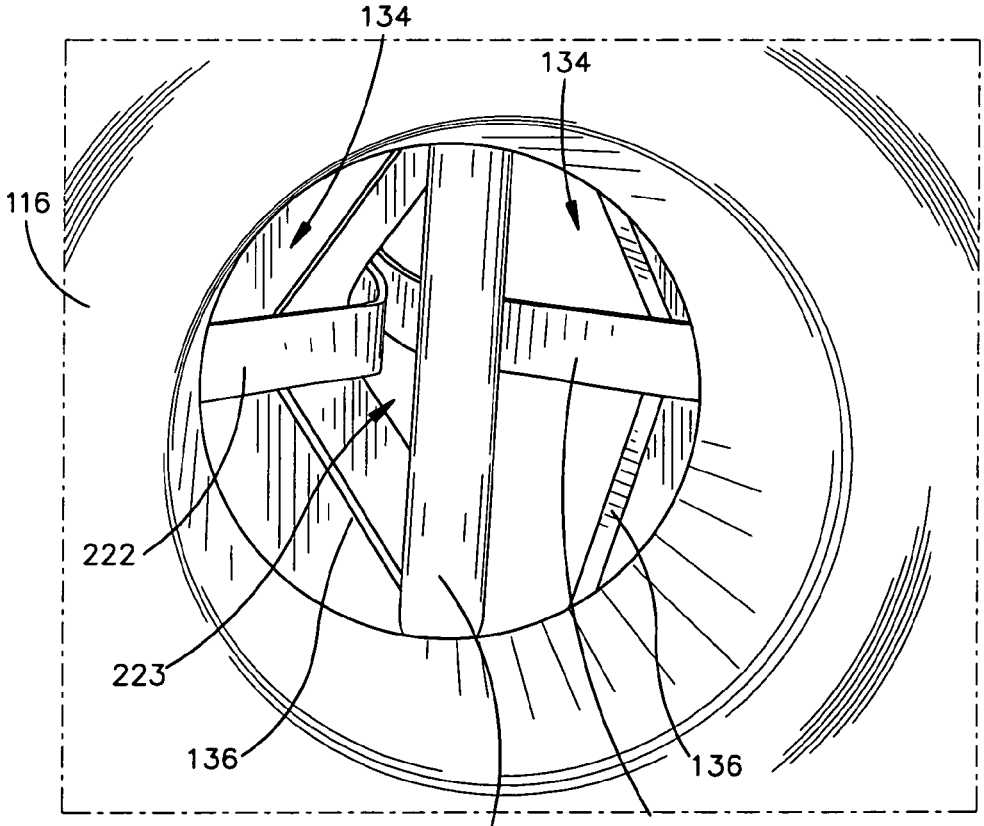
FIG. 21 is an enlarged view of FIG. 20, an enlarged upstream end view of the converter of FIG. 16

The grippers 136 of each feed member 134, where overlapped, preferably do not completely span the aperture in the opposing gripper, thereby leaving a through-gap 223 between the opposed grippers, as best illustrated in FIG. 21. As described above, each gripper 136 has a somewhat V-shape, or outwardly opening, aperture. On opposite sides of the outwardly opening aperture are contact portions (i.e., the arms that form the V-shape opening), which include arm portions (i.e., side contact portions) that are bridged by a base portion (i.e., a central contact portion). The apertures of opposing grippers together form the through-gap 223 therebetween which gradually becomes narrower as the opposed grippers 136 progressively move towards each other. The narrowing of the gap between the grippers eventually reaches a minimal gap size by which the strip of dunnage is fully transversely engaged or captured by the opposing grippers 136. In other words, the arm portions of the opposing grippers move laterally towards (i.e., "close in" on) each other and the base portions of the opposing grippers move transversely towards (i.e., "close in" on) each other altogether to grip or capture the strip of dunnage therebetween.

Figure 22:
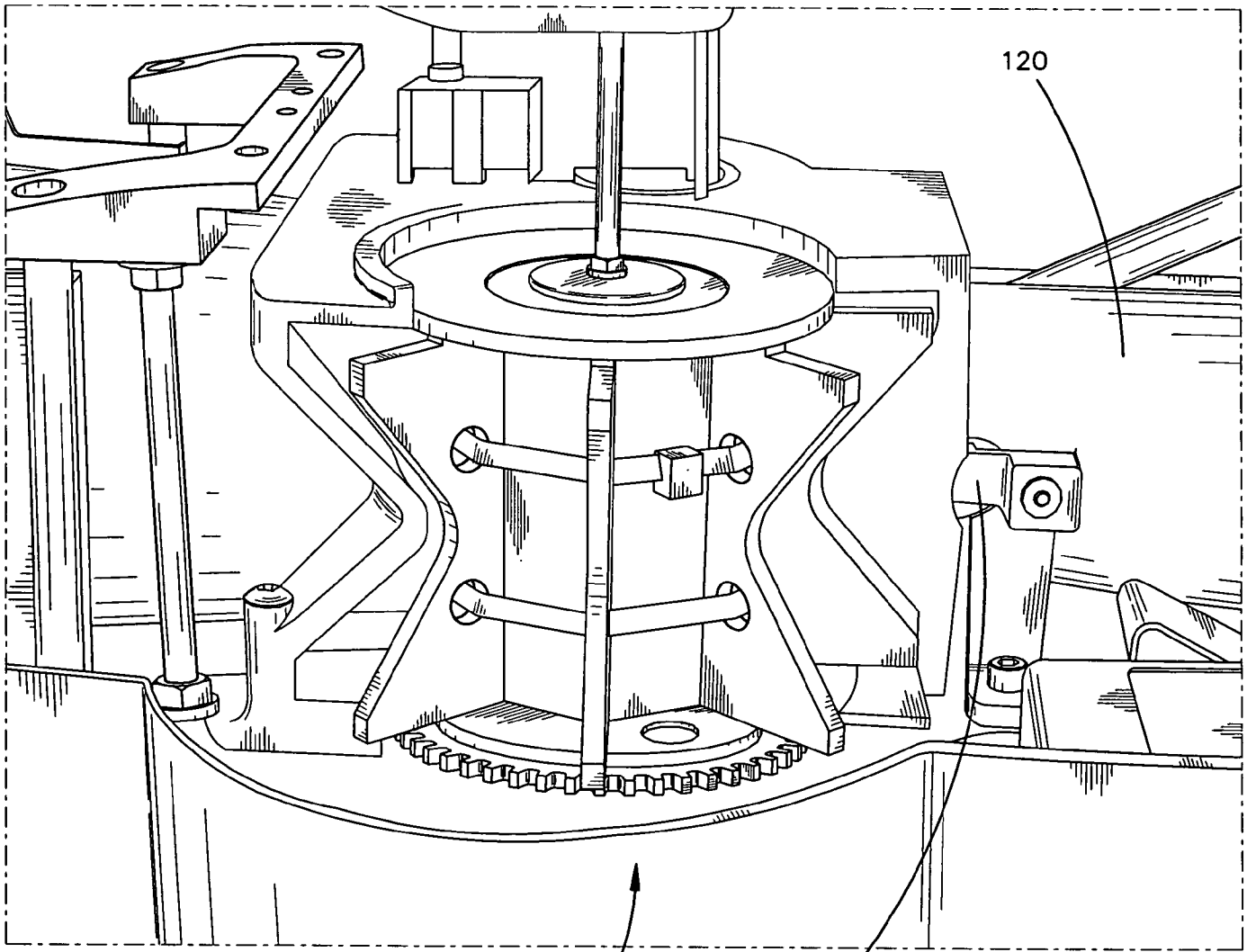
FIG. 22 is an enlarged side perspective view of the converter of FIG. 16 adjacent a feeding assembly.
Figure 25:
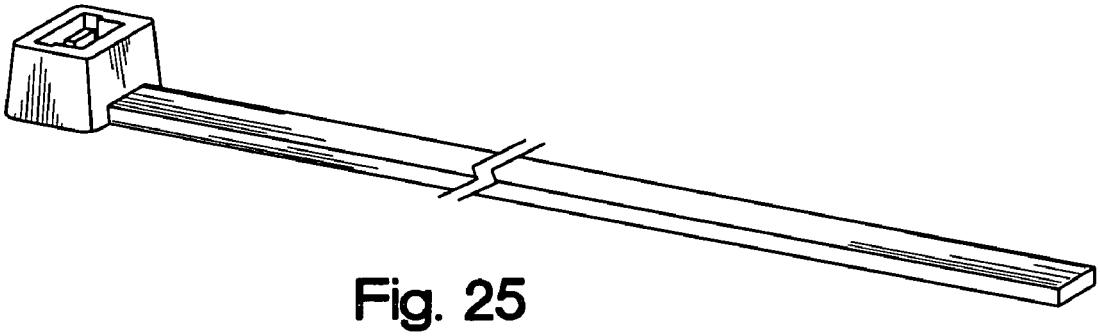
FIG. 25 is a perspective view of an exemplary guide member provided by the present invention.

One end of the guide member 222 is mounted upstream of the feeding assembly 54 to the upstream guide chute 120, as shown in FIG. 22. The downstream end of the guide member 222 extends into the path of the strip 34 and preferably is free (compare FIGS. 19, 23 and 24). As is apparent from comparing FIG. 23 to FIG. 24, each guide member 222 preferably has sufficient flexibility to move out of the way as the strip 34 passes thereby. The guide members 222 can be formed of nylon, such as nylon cable ties, also referred to as tie-wraps, as shown in FIG. 25.

The illustrated elongated guide member 222 has a width that is less than the height of the gap 223. This helps to ensure that the grippers 136 can engage the strip 34. The guide member 222 preferably interferes with the intended functions of the feeding assembly 54 as little as possible, while providing its additional advantages.

The guide members 222 direct the gathered strip 34 through the feeding assembly 54 without significantly impairing the operation of the feeding assembly or the crumpling of the strip as it is fed through the gap 223. In fact, as shown in FIG. 19, for example, crumpled lobes of the strip 34 can extend around the edges of the guide members 222 to engage the grippers 136. An added benefit is that the guide members 222 linearly support the strip 34 as it moves therealong. This reinforcement helps the strip 34 push the restraining members 210 out of the way so that the strip can pass through the restraining members in the downstream direction. The camming action of the restraining members 210 also helps to make this easier for the strip 34 to act against the bias force without significantly backing up in the downstream guide chute 212, which could cause the feeding assembly 54 to jam.

Figure 26:
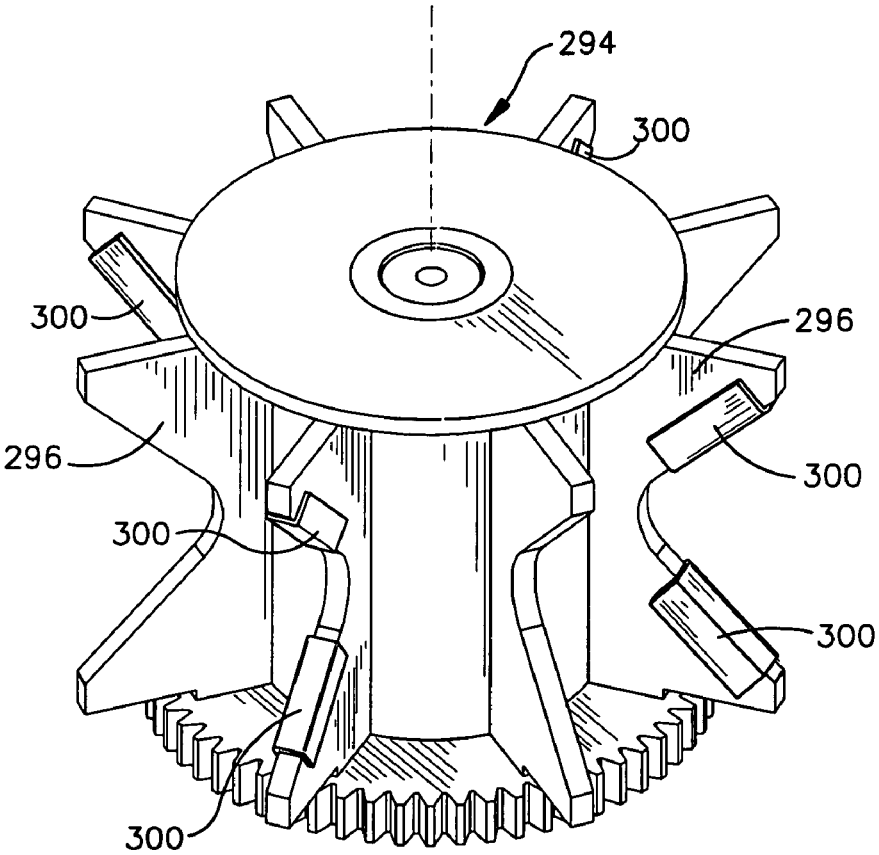
FIG. 26 is a perspective view of another feed member provided by the present invention.

In FIG. 26, a modified feed member 294 is shown, wherein the grippers 136 can be primarily formed of plastic with metal edge strips 300 applied to the sides of the aperture for increased gripping of the stock material while minimizing wear. The edge strips 300 cover at least a portion of the edges of the aperture that engage the strip 34. The edge strips 300 help the grippers 136 grip the strip and advance it through the feeding assembly 54, while minimizing wear of the grippers.

The edge strips 300 typically have an elongated shape, with a squared U-shape cross-section. The edge strips can be secured to the grippers 136 by any suitable means, such as with an adhesive or a mechanical fastening mechanism. Preferably the edge strips are made of aluminum, and more preferably anodized aluminum, which is more wear-resistant than plain aluminum. The edge strips 300 can be applied to each gripper 136 of the feed member 294 if more gripping force is needed, such as in the converter 200 described above. If less gripping force is needed, such as in the converter described in the aforementioned International Patent Application No. PCT/US01/18678, the edge strips can be provided on every other gripper, as shown in FIG. 26. This improves the gripping qualities of the grippers without increasing it so much as to tear the stock material, which is typically kraft paper. Alternatively, at least the edges of the grippers that form the aperture can be made of aluminum, if not the entire gripper.

Although aspects of the invention have been shown and described with respect to one or more illustrated embodiments, equivalent alterations and modifications will occur to others skilled in the art upon reviewing and understanding this description and the annexed drawings. In particular regard to the various functions performed by the above described integers (components, assemblies, devices, compositions, etc.), the terms (including a reference to a "means") used to describe such integers are intended to correspond, unless otherwise indicated, to any integer that performs the specified function (i.e., that is functionally equivalent), even though not structurally equivalent to the disclosed structure that performs the function in the illustrated embodiments. In addition, while a particular feature of the invention may have been described with respect to only one illustrated embodiment, such a feature may be combined with one or more other features of any other embodiment, as may be desired and advantageous for any given or particular application.

What is claimed is:

1. A dunnage converter that converts sheet stock material into discrete dunnage products, comprising:

a conversion assembly for converting sheet stock material into a crumpled strip of dunnage, the conversion assembly including a feeding assembly for engaging the strip at a feeding location and moving the stock material through the converter;

a restraining device that allows the stock material to pass in a forward direction and restricts significant movement of the stock material in a reverse direction at a holding location spaced downstream of the feeding assembly; and a controller that controls the feeding assembly to move the stock material therethrough in a forward direction for conversion into the strip of dunnage and in a reverse direction to separate a dunnage product from the strip at a location at or between the holding location and the feeding assembly.

2. A dunnage converter as set forth in claim 1, wherein the controller directs the feeding assembly to operate in a reverse direction by a preset amount to effect separation of the dunnage product from the strip.

3. A dunnage converter as set forth in claim 1, further comprising an upstream restraining device that allows the stock material to pass in a forward direction and inhibits significant reverse movement of the stock material at a location upstream of the feeding location such that the feeding assembly will engage the stock material upon feeding in the forward direction once again.

4. A dunnage converter as set forth in claim 3, wherein the upstream restraining device includes a stop member movable between a first position permitting passage of the dunnage strip in a forward direction and a second position inhibits significant reverse movement of the stock material at a location upstream of the feeding location such that the feeding assembly will engage the stock material upon feeding in the forward direction once again.

5. A dunnage converter as set forth in claim 4, wherein the stop member is moved to its first position by the stock material passing thereby during forward feeding of the stock material by the feeding assembly, and the stop member is moved to its second position by a binding engagement with the stock material when the stock material is moved in a reverse direction by the feeding assembly.

6. A dunnage converter as set forth in claim 1, comprising a gathering chute upstream of the feeding assembly that has an oval inlet and a funnel shape.

7. A dunnage converter as set forth in claim 1, wherein the feeding assembly includes at least one rotatable feed member.

8. A dunnage converter as set forth in claim 1, wherein the feeding assembly includes a pair of opposed feed members.

9. A dunnage converter as set forth in claim 8, wherein the opposed feed members each include grippers that cooperate to grip and feed the stock material therebetween.

10. A dunnage converter as set forth in claim 1, in combination with a stock material having longitudinally spaced-apart weakened areas that extend across the width of the stock material.

11. A dunnage converter as set forth in claim 10, wherein the weakened areas are formed by perforations.

12. A dunnage converter that converts sheet stock material into discrete dunnage products, comprising:

a conversion assembly for converting sheet stock material into a crumpled strip of dunnage, the conversion assembly including a feeding assembly for engaging the strip at a feeding location and moving the stock material through the converter;

a restraining device that allows the stock material to pass in a forward direction and restricts significant movement of the stock material in a reverse direction at a holding location spaced downstream of the feeding assembly; and a controller that controls the feeding assembly to move the stock material therethrough in a forward direction for conversion into the strip of dunnage and in a reverse direction to separate a dunnage product from the strip at a location at or between the holding location and the feeding assembly, wherein the downstream restraining device includes at least one restraining member moveable between a closed position in the path of the stock material to engage the stock material at the holding location and hold it against any significant reverse movement at the holding location and an open position that allows the stock material to move forward in a downstream direction.

13. A dunnage converter as set forth in claim 12, wherein the restraining member is resiliently biased to the closed position.

14. A dunnage converter as set forth in claim 13, wherein each restraining member has a camming portion that extends toward the path of the strip and causes the restraining member to be moved outwardly against the biasing force.

15. A dunnage converter as set forth in claim 13, wherein the restraining member is biased to the closed position by a spring.

16. A dunnage converter as set forth in claim 12, further comprising an actuator for moving the restraining member between the open and closed positions.

17. A dunnage converter as set forth in claim 12, wherein the restraining member has an edge that bites into the strip at the holding location.

18. A dunnage converter as set forth in claim 17, wherein the restraining members have teeth that bite the strip at the holding location.

19. A dunnage converter as set forth in claim 12, wherein the downstream restraining device includes opposed restraining members.

20. A dunnage converter converts sheet stock material into discrete dunnage products, comprising:

a conversion assembly for converting sheet stock material into a crumpled strip of dunnage, the conversion assembly including a feeding assembly for engaging the strip at a feeding location and moving the stock material through the converter;

a restraining device that allows the stock material to pass in a forward direction and restricts significant movement of the stock material in a reverse direction at a holding location spaced downstream of the feeding assembly; and a controller that controls the feeding assembly to move the stock material therethrough in a forward direction for conversion into the strip of dunnage and in a reverse direction to separate a dunnage product from the strip at a location at or between the holding location and the feeding assembly;

wherein the restraining device includes an upstream restraining device that allows the stock material to pass in a forward direction and inhibits significant reverse movement of the stock material at a location upstream of the feeding location such that the feeding assembly will engage the stock material upon feeding in the forward direction once again, the upstream restraining device including a stop member movable between a first position permitting passage of the dunnage strip in a forward direction and a second position inhibits significant reverse movement of the stock material at a location upstream of the feeding location such that the feeding assembly will engage the stock material upon feeding in the forward direction once again, the stop member is moved to its first position by the stock material passing thereby during forward feeding of the stock material by the feeding assembly, and the stop member is moved to its second position by a binding engagement with the stock material when the stock material is moved in a reverse direction by the feeding assembly; and wherein the downstream restraining device includes at least one restraining member moveable between a closed position in the path of the stock material to engage the stock material at the holding location and hold it against any significant reverse movement at the holding location, and an open position that allows the stock material to move forward in a downstream direction.

21. A dunnage converter as set forth in claim 20, wherein the restraining member has an edge that bites into the strip at the holding location.

22. A dunnage converter as set forth in claim 20, further comprising an actuator for moving the restraining member between the open and closed positions.

23. A dunnage converter as set forth in claim 20, wherein the downstream restraining device includes opposed restraining members.

24. A dunnage converter as set forth in claim 23, wherein an exit guide chute is provided to constrain the stock material as it passes from the feeding assembly, and the restraining member is located at an outlet end of the exit guide chute.

* * * * *

UNITED STATES PATENT AND TRADEMARK OFFICE

CERTIFICATE OF CORRECTION

PATENT NO. : 7,186,208 B2
APPLICATION NO. : 10/887220
DATED : March 6, 2007
INVENTOR(S) : Demers et al.

It is certified that error appears in the above-identified patent and that said Letters Patent is hereby corrected as shown below:

On the title page, item 60 after the filing date, please insert:

--Related U.S. Application Data
Provisional application No. 60/504,762 filed on Sep. 22, 2003, provisional application No. 60/485,283, filed on Jul. 7, 2003.--

Signed and Sealed this
Fifth Day of January, 2016

Michelle K. Lee

Michelle K. Lee
*Director of the United States Patent and Trademark Office*